US007524272B2

(12) United States Patent
Bruck et al.

(10) Patent No.: US 7,524,272 B2
(45) Date of Patent: Apr. 28, 2009

(54) EXERCISE MACHINE WITH SEMI-DEPENDENT RETRACTION SYSTEM

(75) Inventors: Robert C. Bruck, Middleton, WI (US); Mark J. Kannel, Oconomowoc, WI (US); Donald E. Stiemke, Madison, WI (US); Nathan Pyles, Lake Mills, WI (US); Ronald H. Carringi, Madison, WI (US); J. Addison Pettis, Mazomanie, WI (US); Daniel D. Budworth, Milton, WI (US)

(73) Assignee: Johnson Health Tech Co., Ltd., Taichung Hsein (TW)

( * ) Notice: Subject to any disclaimer, the term of this patent is extended or adjusted under 35 U.S.C. 154(b) by 0 days.

(21) Appl. No.: 11/423,537

(22) Filed: Jun. 12, 2006

(65) Prior Publication Data

US 2007/0287601 A1 Dec. 13, 2007

(51) Int. Cl.
*A63B 21/045* (2006.01)
*A63B 22/02* (2006.01)

(52) U.S. Cl. ..... 482/127; 482/54; 482/126

(58) Field of Classification Search ..... 482/51, 482/54–56, 62, 70, 72, 121–122, 126–127, 482/116; *A63B 21/045, 22/02*
See application file for complete search history.

(56) References Cited

U.S. PATENT DOCUMENTS

| | | | | |
|---|---|---|---|---|
| 852,193 | A * | 4/1907 | McMillan | 607/78 |
| 4,537,396 | A * | 8/1985 | Hooper | 482/8 |
| 4,625,962 | A | 12/1986 | Street | |
| 4,728,102 | A * | 3/1988 | Pauls | 482/118 |
| 5,180,351 | A * | 1/1993 | Ehrenfried | 482/52 |
| 5,354,251 | A | 10/1994 | Sleamaker | |
| 5,437,591 | A * | 8/1995 | Chen | 482/127 |
| 5,476,431 | A | 12/1995 | Wilkinson | |
| 5,527,245 | A | 6/1996 | Dalebout | |
| 6,123,649 | A | 9/2000 | Lee et al. | |
| 6,328,677 | B1 * | 12/2001 | Drapeau | 482/72 |
| 6,569,065 | B1 | 5/2003 | Menold et al. | |
| 6,599,223 | B2 | 7/2003 | Wang | |
| 6,723,028 | B1 | 4/2004 | Wang et al. | |
| 6,790,163 | B1 * | 9/2004 | Van De Laarschot et al. | 482/56 |
| 7,052,440 | B2 * | 5/2006 | Pyles et al. | 482/54 |
| 2005/0124471 | A1 | 6/2005 | Wilkinson et al. | |
| 2005/0130807 | A1 | 6/2005 | Cutler et al. | |
| 2005/0209059 | A1 | 9/2005 | Crawford et al. | |
| 2006/0287186 | A1 * | 12/2006 | Kamiya et al. | 501/36 |

* cited by examiner

*Primary Examiner*—Loan H Thanh
*Assistant Examiner*—Oren Ginsberg
(74) *Attorney, Agent, or Firm*—Michael Best & Friedrich LLP

(57) ABSTRACT

Disclosed is an exercise machine providing an upper body exerciser portion adapted for use with a lower body exerciser and having a semi-dependent retraction system. The exercise machine generally includes a frame adapted to be mounted on a lower body exerciser (though standalone versions are also disclosed) and the upper body exerciser consisting of first and second user members for pulling by a user to provide pull forces, single retraction means for providing retraction forces to the user members sufficient to retract them back to their start positions after being pulled out, and, non-floating combining means coupled to the single retraction means for making the retraction forces semi-dependent on the pull forces, and thereby reducing travel of the retraction means, by coupling the single retraction means to both user members. Drive and resistance means are further provided.

18 Claims, 14 Drawing Sheets

SECTION A-A

SECTION A-A

SECTION B-B

EXERCISE MACHINE WITH SEMI-DEPENDENT RETRACTION SYSTEM

BACKGROUND

Dual-function exercisers provide the ability for a user to simultaneously exercise his or her upper and lower body, thus increasing a whole-body workout in reduced time. Many such dual-function exercisers exist on the market today and are widely used in both health clubs and homes. However, the problem remains unsolved as to how to provide an upper body exerciser portion specifically adapted for simultaneous use with a lower body exerciser that both (a) allows a user a fall range of arm movements, including the cycling of hand-grips and/or pull cords in opposition, while also providing adequate and adjustable load forces and a smooth feel to the user, and, (b) reduces maintenance requirements and cost by increasing the cycle life of its parts.

Information potentially relevant to attempts to address these and related problems may be found in U.S. Pat. No. 4,625,962 to Street; U.S. Pat. No. 5,354,251 to Sleamaker; U.S. Pat. No. 5,476,431 to Wilkinson et al.; U.S. Pat. No. 5,527,245 to Dalebout; U.S. Pat. No. 6,123,649 to Lee et al.; U.S. Pat. No. 6,569,065 to Menold et al.; U.S. Pat. No. 6,599,223 to Wang; and U.S. Pat. No. 6,723,028 to Wang et al.; and in U.S. Published Patent Applications 2005/0124471 A1 by Wilkinson et al.; 2005/0130807 by Cutler et al.; and 2005/0209059 A1 by Crawford et al. However, each of these references suffers from one or more of the following disadvantages: (1) they provide dual-function exercisers with only fully independent retraction systems for the upper body portion where the extension of one pull cord has no effect on the position or tensioning of the other, tension in the pull cords increases as the cord is extended, two retraction devices are required, and the retraction devices are cycled (travel) every time the cord is extended which greatly increases the risk of fatigue failure (see, e.g., U.S. Pat. Nos. 4,625,962; 5,354,251; 5,476,431; 6,569,065; 6,723,028; US2005/01244761A1; US 2005/0130807A1; and, US2005/0209059A1); (2) they provide dual-function exercisers with totally dependent pull systems for the upper body portion with no retraction devices in which limiting motion of one arm to the opposition motion of the other arm, many providing only an equal resistance for each arm with pull cables that are not fully retractable (see, e.g., US 2005/01244761A1); (3) they provide dual-function exercisers with semi-dependent resistance systems, but, because the exercise is designed to be a push-pull exercise and because retraction is a secondary function, it is not sufficient to retract pull cords for an upper body portion back to a start position and therefore cannot function to provide a user with a full range of upper body arm movements and exercises (see, e.g., U.S. Pat. No. 5,527,245), or they employ floating pulleys located after the hand grips and before the drive, resistance, and retraction mechanisms, which results in a bypassing of the resistance mechanism when a user tries to cycle the left and right pull cords, removing all loads except for a small retraction force and eliminating adjustability of the load (see, e.g., U.S. Pat. No. 6,599,223); (4) they provide single-function exercisers which are designed for higher loads, slower speeds and fewer repetitions (e.g., certain weight-stack type strength equipment) that would be unsuited to a cardiovascular exercise because the higher weight would exhaust the user too quickly, and the high speed/high frequency repetitions typical in a cardiovascular workout, would produce too much bounce in the weight system; or, (5) they provide single-function exercisers for the lower body only with retraction systems not appropriate to upper body use (see, e.g., U.S. Pat. No. 6,123,649 with fully independent retraction system).

For the foregoing reasons there is a need for an upper body exerciser specifically adapted for use with lower body exercisers which can provide both smooth and varied operation under sufficient load forces substantially constant with extension of a pull cord, while increasing fatigue life and space-efficiency of the unit by reducing travel of its retraction mechanism.

SUMMARY

The present invention is directed to a method that satisfies the need for an upper body exerciser specifically adapted for use with lower body exercisers which can provide both smooth and varied operation under sufficient load forces substantially constant with extension of a pull cord, while improving fatigue life and space-efficiency of the unit by reducing travel of its retraction mechanism. It does so by providing an exercise machine with an upper body exerciser making retraction and pull forces exerted on the hand-grips and/or pull-cords semi-dependent, thereby providing a smooth feel to the user while reducing displacement (or travel) of retraction means, reducing risk of fatigue life failure and substantially increasing reliability of the upper body exerciser. The exercise machine of the present invention thus both provides users a smooth feel during operation and owners a machine that is highly durable with reduced maintenance costs and improved space-efficiency.

The exercise machine of the present invention generally includes a frame and an upper body exerciser connected to the frame. The upper body exerciser generally includes a first user member for pulling by a user from a start position to a second position with a first pull force; a second user member for pulling by the user from a start position to a second position with a second pull force; single retraction means for providing a first retraction force to the first user member and a second retraction force to the second user member, the first and second retraction forces being sufficient to retract the first and second user members from their respective second positions to their respective start positions; and non-floating combining means coupled to the single retraction means for making the first and second retraction forces semi-dependent on the second and first pull forces, respectively, and thereby reducing travel of the retraction means, by coupling the single retraction means to both the first and second user members so that a portion of the first pull force is added to the second retraction force and a portion of the second pull force is added to the first retraction force when the user pulls the first and second user members, respectively. By combining the positive travel (i.e., pulling motion) of the user's one arm, and the negative travel (i.e., retracting motion) of the user's second arm, the combining means adds the motion of the two swinging arms into a substantially zero travel at the retraction means. In this way, the upper body exerciser provides a smooth feel to the user while reducing displacement (or travel) of retraction means, and reducing risk of fatigue life failure substantially increasing reliability of the upper body exerciser.

The frame of the upper body exerciser may be integrally connected to a lower body exerciser, connected as an add-on feature to a lower body exerciser, or adapted to support the upper body exerciser as a standalone application for positioning proximate a separate lower body exerciser so as to enable its simultaneous use In another version the upper body exerciser further includes a support member, resistance means for providing resistance forces to the first and second user members, and drive means for driving the support member and resistance means, the drive and resistance means being supported on the support member and located between the combining means and first and second user members.

In another version, the retraction means comprises an elastomeric cord having a first portion coupled to the first user member, a second portion coupled to the second user member, and a middle portion coupled to the combining means. In a variation of this version, resistance means for providing a resistance to the first and second user members, and drive means for driving the resistance means are provided and are located between the first and second user members and the combining means.

In still another version, a first support member is provided and the combining means includes a first member and a second member, the first and second members each being fixed in position on the first support member and linked one to the other via the retraction means, the retraction means likewise being fixed in position on the support member. In a variation of this version, resistance means for providing resistance forces to the first and second user members, and drive means for driving the second support member and resistance means are also provided. The resistance and drive means may also be supported on the first support member, or a second support member may be provided for their support.

In yet another version, a support member and a drive means consisting of gears for driving the support member and combining means are provided, the combining means consisting of a differential gear that orbits around the support member.

Several objects and advantages of the present invention are: (a) providing a dual-function exercise machine with an integrated durable and long-wearing upper body exerciser employing a semi-dependent retraction system so as to provide the smooth feel of an independent retraction system, but without the variation in load force with extension of pull cords and disadvantage of short cycle life of its retraction means; (b) providing the functionality of an upper body exerciser as recited at (a) in a standalone version that can be used with existing lower body exercisers; and, (c) providing the functionality of an upper body exerciser as recited at (a) in a self-contained version that can be attached to an existing lower body exerciser as an add-on feature.

The reader is advised that this summary is not meant to be exhaustive. Further features, aspects, and advantages of the present invention will become better understood with reference to the following description, accompanying drawings and appended claims.

BRIEF DESCRIPTION OF THE DRAWINGS

For a better understanding of the present invention, reference may be made to the accompanying drawings, in which:

FIG. 6*a* depicts a front view; FIG. 6*b* depicts a cross sectional view through sections A-A shown in FIG. 6*a; * FIG. 6*c* depicts a top view; FIG. 6*d* depicts a side view; and, FIG. 6*e* depicts a top perspective view;

FIG. 7*a* depicts a top perspective view from the side; FIG. 7*b* a front view; and, FIG. 7*c* a side view;

FIG. 8*a* depicts a top view; FIG. 8*b* depicts a cross-sectional view through section A-A shown in FIG. 8*a; * FIG. 8*c* depicts a cross-sectional view through section B-B shown in FIG. 8*b; * and FIG. 8*d* depicts a top perspective view of this version; and, FIGS. 9*a*-9*d* depict various views of a sixth embodiment of the upper body exerciser of the present invention in which differential gearing is employed; FIG. 9*b* depicts a cross-sectional view through section A-A shown in FIG. 9*a.

Figure 1A:
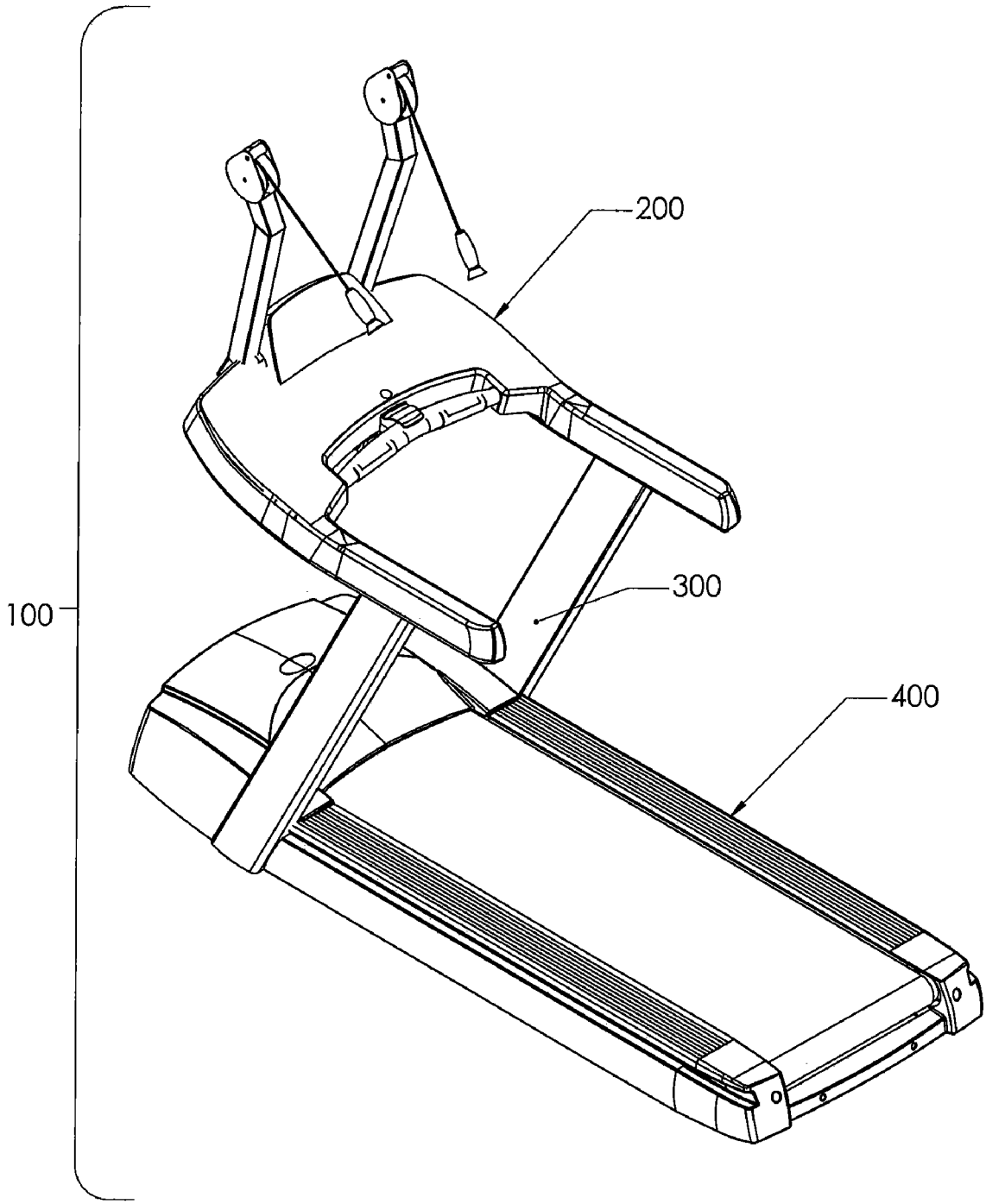
FIGS. 1*a*-1*c* depict several views of a version of the present invention including a lower body exerciser—top perspective view from one side (FIG. 1*a*); side view (FIG. 1*b*); and back view (FIG. 1*c*)

Referring now specifically to the figures, in which identical or similar steps or parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

It should also be understood that, while the methods disclosed herein may be described and shown with reference to particular steps taken in a particular order, these steps may be combined, sub-divided, or re-ordered to form an equivalent method without departing from the teachings of the present invention. Accordingly, unless specifically indicated herein, the order and grouping of the steps is not a limitation of the present invention.

Definitions

Combining means—A combining means is a device for loosely linking, or combining, the forces of a first user member (such as a hand grip and/or pull cord), a second user member, and a single retraction means. Some examples of combining means may include pulleys, counter-rotating pulleys, spools and the like. Combining means may be floating, meaning that the device travels lengthwise or side-to-side while suspended in space (e.g., floating pulley systems), or non-floating. Non-floating combining means may move while fixed in position (i.e., stationary, as opposed to being suspended in space). Movement of non-floating combining means (e.g., spools, fixed pulleys and the like) might typically be rotationally about a support member.

Dependent retraction—Dependence refers to the fact that in a dependent retraction system, the retraction (travel distance) of a first user member (such as a hand-grip) is proportionate or substantially equal to (totally dependent on) the extension (travel distance) of a second hand-grip when a user pulls it out. There is no retraction mechanism required because the user provides the retraction.

Drive means—A drive means is a device for driving a drive shaft and/or a resistance means. Drive means may include devices such as clutched spools and the like.

Independent retraction—Independence refers to the fact that in an independent retraction system, a first user member (such as a hand-grip) is coupled to a first retraction means and a second user member is coupled to a second retraction means. The amount of retraction force exerted on the first hand-grip is totally independent from the amount of pull force exerted on the second hand-grip. In other words, there is a separate retraction mechanism coupled to each user member so that each user member retracts independently of one another.

Resistance means—A resistance means is a device for providing resistance forces to user members (such as hand-grips, pull cords, and the like) as they are pulled out by a user. Examples of resistance means include devices that provide dynamic braking, or drag forces (e.g., Eddy-Current Brake, or ECB, friction brake, fan, water wheel, or the like), inertial load (e.g., via a flywheel), or other means of providing resistance force.

Retraction means—A retraction means is a device for exerting a retraction force on an object. Examples of retraction means may include resilient devices which employ spring force (e.g., elastomeric cords, extension springs, power springs, torsion springs and the like), or other devices capable of exerting retractive forces. Weight systems are to be excluded from this definition because the inertia associated with a weight system tends to produce an excessive amount of bounce during high speed/high frequency cardiovascular exercises.

Semi-dependent retraction—Semi-dependence refers to the fact that in a semi-dependent retraction system, the distance traveled by a single retraction means is split between a first user member (such as a hand-grip or pull cord) and a second, user member. The sum of the travel distances of the two user members is proportionate to the travel distance of the single retraction means. If the retraction means is stationary, the first user member can retract while the second user member is extended (and vice-versa), similar to a dependent retraction system. However, both user members can be retracted (or extended) at the same time, similar to an independent retraction system. If the retraction means travels any distance, that motion adds a proportionate amount of travel to one or both of the user members. In this way, the travel of each of the user members is semi-dependent (or loosely linked). The two user members are able to move independently of one another, but force applied to one adds to force seen by the other.

DETAILED DESCRIPTION

Figure 1C:
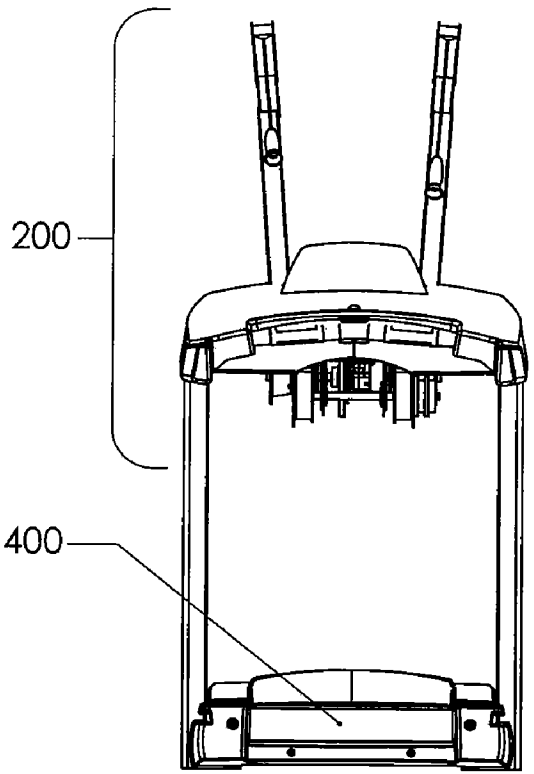
Figure 1B:
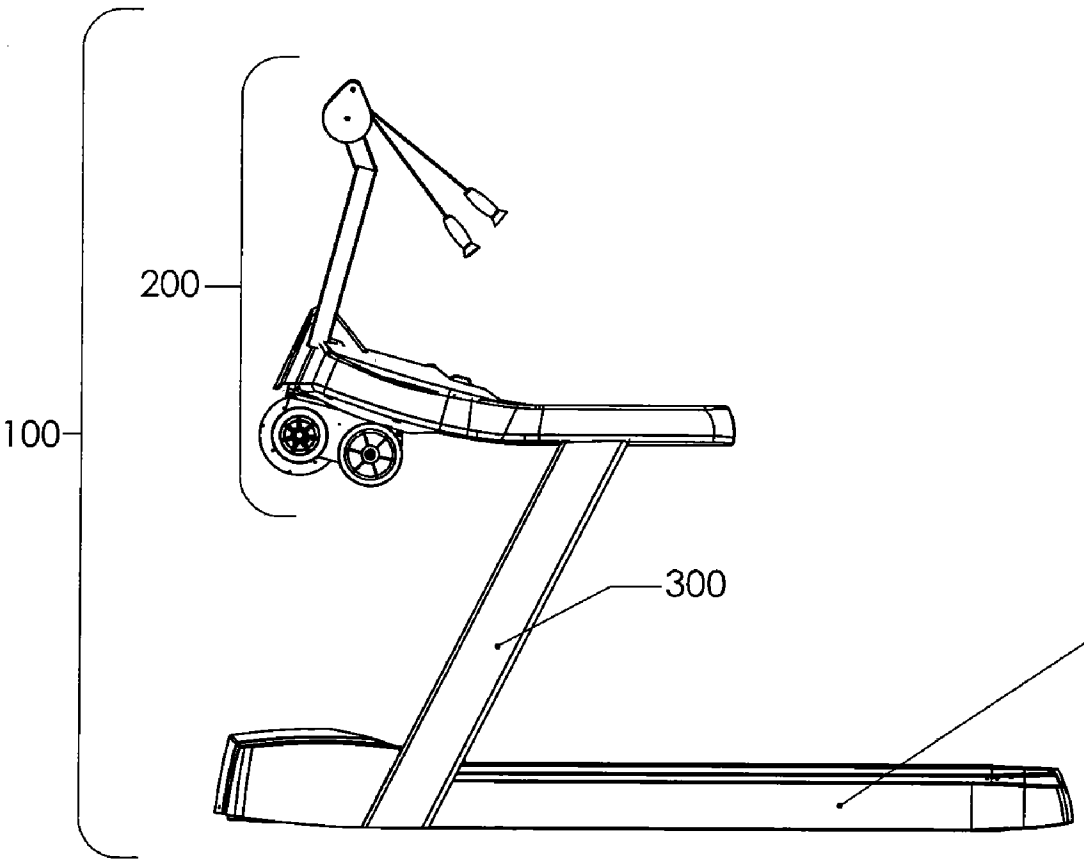

Referring to FIGS. 1*a*-1*c*, the present invention is an exercise machine 100 with an upper body exerciser portion 200 attached to a frame 300 and adapted for use with a lower body treading exerciser 400, thus providing a user the ability to exercise both the upper and lower body simultaneously.

The upper body exerciser 200 is specially adapted to provide upper body exercise appropriate to simultaneous lower body exercising. The upper body exerciser 200 of the present invention is designed for a user cycling each user member 222/224 (e.g. hand-grip and rope) at rates of up to 100 cycles per minute for each user member. The user's arm swings all the way forward, with the arm outstretched to grasp the user member (i.e., a start position), then the user pulls the user member 222 or 224 to a second position, potentially all the way back behind their body (i.e., one example of a second position), necessitating a long rope travel. Because it is to be used in a cardio exercise, the ropes need to retract fast without creating much slack in the system. Also, the forces need to be at a low enough level to allow a user to get approximately 4,000 repetitions (i.e., 2,000 cycles for each arm) during the course of a half-hour exercise without over-fatiguing their muscles. Because of these requirements of low force, long rope travel, high speed, and high frequency, a very responsive and specialized device needs to be created to meet the requirements of this upper-body exercise. As an example, a lower body exercise (e.g., treadmill) could not just be attached to a standard cabled weight machine to meet these requirements, because the weight of the machine would be too large for a high repetition exercise, and the long rope travel at high speeds would tend to make the weights bounce.

Figure 2:
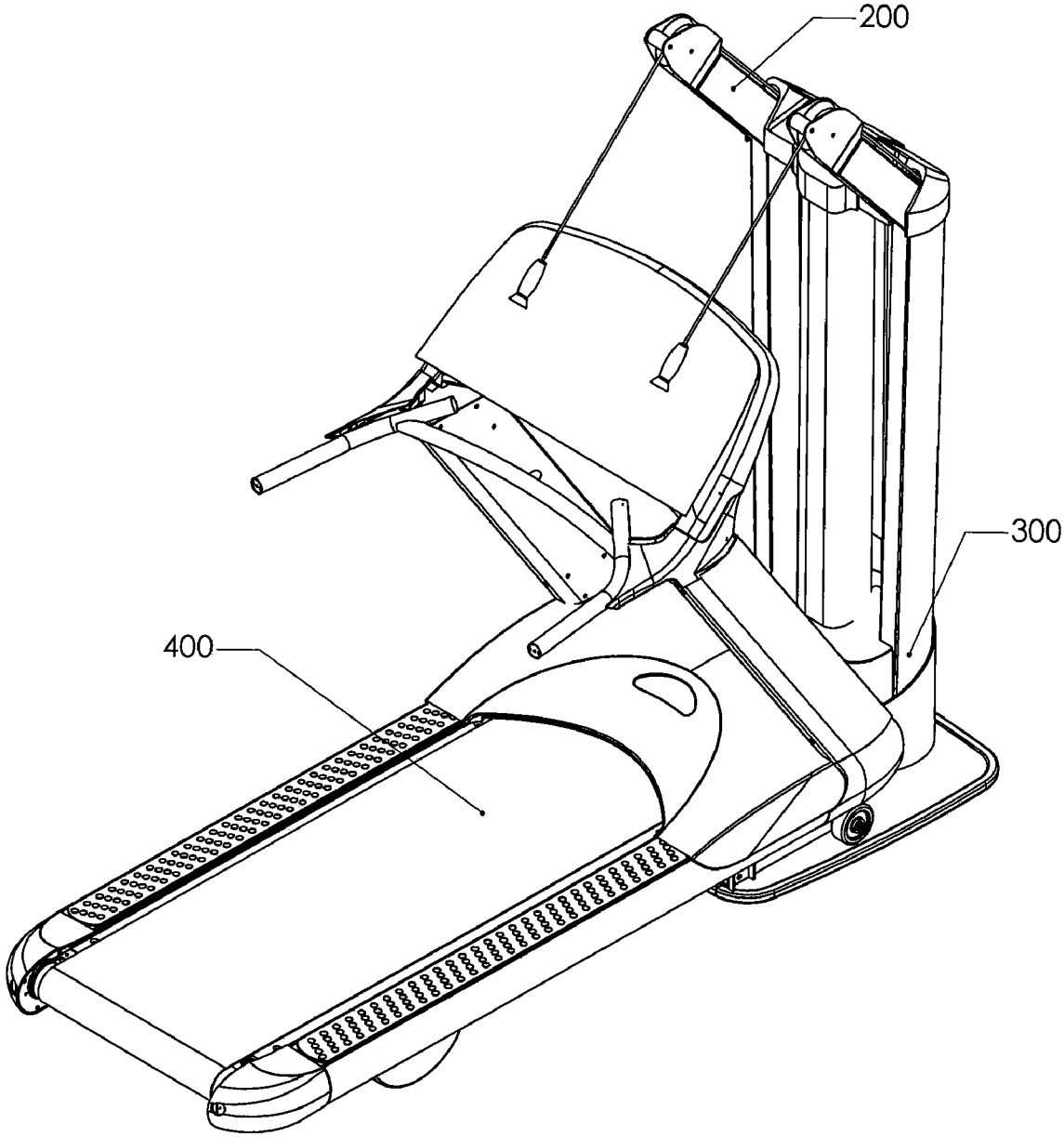
FIG. 2 depicts a standalone version of a device embodying the present invention as it might typically be positioned proximate a separate lower body exerciser convenient to a user of both.

The exercise machine 100 may be dual-function and comprise both the upper and lower body exerciser portions 200/400 (see FIGS. 1*a*-1*c*), or it may comprise only the upper body portion 200 and frame 300 alone in a standalone version (see FIG. 2). The standalone version of the present invention provides upper body exerciser functionality to existing single-function lower body exercisers such as treadmills and the like. A user is effectively provided with a dual-function exerciser by simply situating it near the treadmill.

The lower body exerciser 400 will generally consist of a treading exerciser of some kind such as a treadmill or the like on which the user may run or walk in order to exercise his or her lower body.

The frame 300 is connected to the upper body exerciser 200 and may generally be adapted to be mounted on the lower body exerciser 400, thus functioning to connect the two. However, in standalone versions of the exercise machine 100, the frame 300 is not mounted on the lower body exerciser 400. Instead, it is adapted to support the upper body exerciser 200 in a stable position proximate a separate lower body exerciser. The frame 300 may further comprise a mounting mechanism for mounting on a wall, floor or other surface. Alternatively, the frame 300 may consist of a base which sits upon a floor surface or is fitted with wheels or castors to enable the machine 100 to be rolled into position proximate the lower body exerciser.

As mentioned above, the upper body exerciser 200 of the present invention is attached to the frame 300 and is specially adapted for use with a lower body exerciser 400.

Figure 3A:
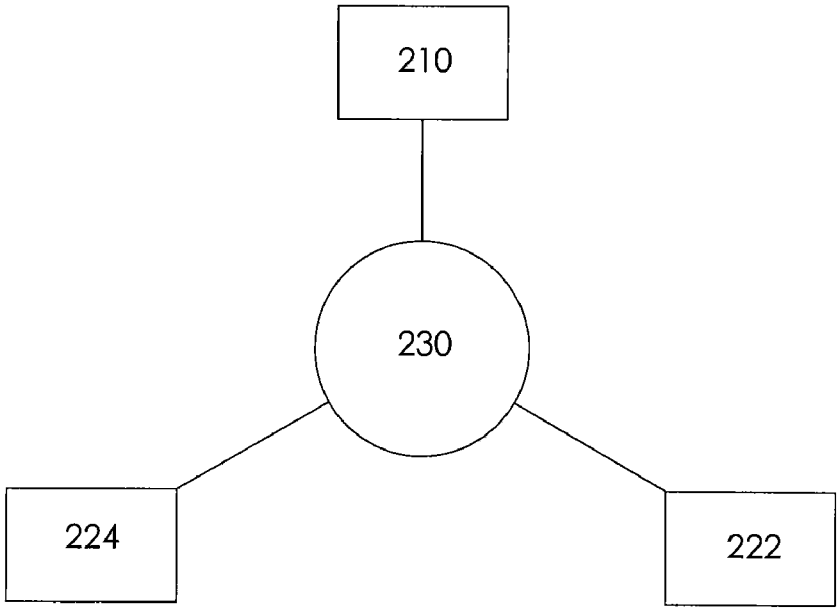
FIG. 3*a* shows a schematic of the basic orientation of user members, combining means and retraction means in the semi-dependent system of the upper body exerciser of the present invention.

The upper body exerciser 200 includes first and second user members 222/224, a single retraction means 210 and a combining means 230 (see FIG. 3*a* for general orientation of parts, and FIGS. 4-9*d* generally).

The first and second user members 222/224 consist of hand-grips 222*b*/224*b*, pull cords 222*a*/224*b* or a combination of both. Each first and second user member 222/224 is pulled out by the user from a start position proximate the upper body machine (i.e., the-user's arm is swung all the way forward, with the arm outstretched to grasp the user member) to a second position some distance away from the upper body machine (e.g., the user pulls the user member 222 or 224 down and away from the start position). A first pull force is the amount of force exerted by the first user member 222 as the user pulls it out from the start to the second position. A second pull force is the amount of force exerted by the second user member 224 as the user pulls it out from the start to the second position.

The single retraction means 210 is a device for exerting a retraction force on an object. The retraction means 210 provides a first retraction force to the first user member 222 and a second retraction force to the second user member 224. These first and second retraction forces are sufficient to retract the first and second user members from their respective second positions to their respective start positions. Various types of retraction means 210 may be used, including resilient retraction means which employ a spring element providing a force (such as elastomeric cords, extension springs, torsion springs such as power springs and the like), or other devices that are capable of exerting retractive forces. Devices that exert gravitational retraction forces, such as weights, are not ideal for this purpose because exercisers designed for higher loads and slower speeds and lower repetitions (e.g., certain weight-stack type strength equipment) would be unsuited to a cardiovascular exercise (because the higher weight would exhaust the user too quickly), and the high speed/high frequency repetitions would produce too much bounce in the weight system.

The combining means 230 are devices for loosely linking, or combining, user members 222/224 and for coupling them to the single retraction means 210. The combining means 230 functions to make the first and second retraction forces semi-dependent on the second and first pull forces, by coupling the single retraction means 210 to both the first and second user members 222/224 so that a portion of the first pull force is added to the second retraction force and a portion of the second pull force is added to the first retraction force when the user pulls the first and second user members, respectively (see FIG. 3*a* for basic orientation of the parts). In other words, the amount of retraction force exerted by the single retraction means 210 on the first user member 222 is semi-dependent on the amount of pull force exerted on the second user member 224 when the user pulls it out. Semi-dependence of the retraction system is gained by having the single retraction means 210 coupled to both user members 222/224 by a combining means 230.

Some examples of combining means 230 may include types that are floating devices meaning that the device travels through space (e.g., lengthwise or side-to-side as in floating pulley systems). Alternatively, combining means may be non-floating meaning they allow motion while they themselves are fixed in position (i.e., stationary, as opposed to being suspended in space). Non-floating combining means (e.g., retraction spools, fixed pulleys, counter-rotating pulleys and the like), though fixed in position, might typically move by rotating on a support member such as a shaft.

Note that when floating combining means 230 are used in conjunction with a drive means 250 (see below), the drive means must be located between the user members 222/224 and the combining means 230 (see FIG. 3*b* for schematic of this basic orientation of the parts). If, by contrast, the drive means 250 is located instead between the combining means 230 and retraction means 210, the drive means 250 (and resistance means if resistance means 260 are also included) are by-passed, and user will essentially just be cycling the user members 222/224 back and forth about the combining means 230. This effectively removes the drive means (and resistance means if included) from the system, leaving only the small retraction forces to tension the user members. These forces are insufficient to provide adequate upper body exercise.

The semi-dependence of retraction and pull forces functions to, among other things, minimize travel of the retraction means 210 while in use, thereby substantially increasing its cycle life and greatly reducing failure due to fatigue. This is particularly true for versions of the present invention in which the retraction means 210 includes a spring element. This is because reducing the distance a spring travels, or is stretched, during use greatly reduces the internal stresses in the spring, substantially reducing failure due to fatigue. The life cycle of a spring type retraction means 210 may increase on the order of 50 fold. Needless to say, this has the advantage of greatly reducing the requirement and expense for maintenance.

Reducing travel also results in space-efficiency of such a device. The distance the retraction means 210 moves, or travels, is reduced. This enables the upper body exerciser 200 to be housed in smaller spaces, streamlining the exercise machine 100 and enabling it to take up less space. This is an advantage in health clubs and homes alike where space is limited.

Figure 3B:
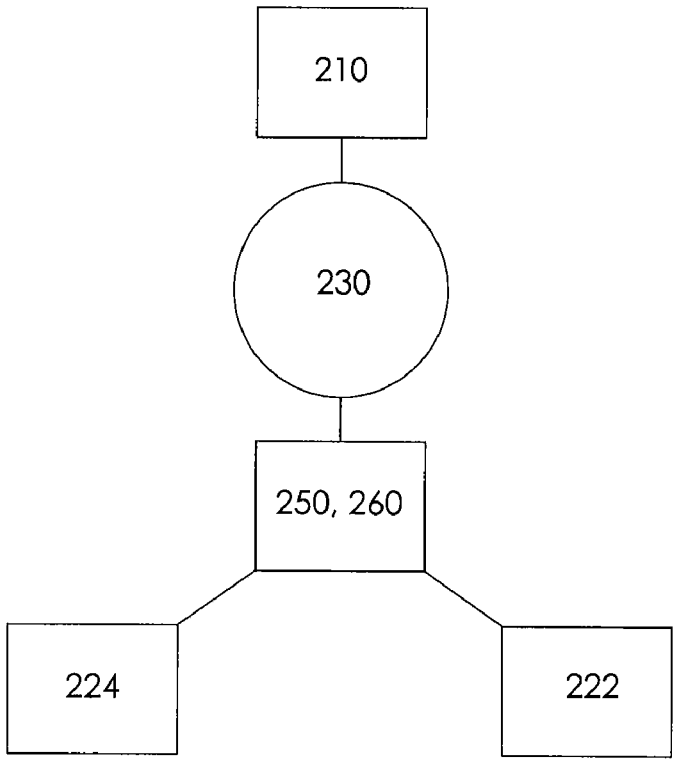
FIG. 3*b* shows a schematic of the basic orientation of user members, combining means and retraction means as in FIG. 3*a,* when the upper body exerciser of the present invention further comprises drive and resistance means.

The upper body exerciser 200 may further comprise drive means 250 and resistance means 260 (see FIG. 3*b* for orientation of parts when drive and resistance means are present).

Drive means 250 are devices for driving a support member such as a drive shaft, the resistance means 260, or both. Drive means 250 may include devices such as clutched spools and the like (see FIG. 3*b* for orientation of parts when drive means 250 are present).

Resistance means 260 are devices for providing resistance forces to user members 222/224 as they are pulled out by the user. Examples of resistance means 260 include devices that provide resistance forces via dynamic braking, or drag forces (such as Eddy-Current Brake, or ECB, friction brake, fan, water wheel, etc.), inertial load (e.g., via a flywheel), or via other means (see FIG. 3*b* for orientation of parts when resistance means 260 are present).

Various embodiments of the upper body exerciser 200 are possible. Examples of some of these variations follow.

Figure 4:
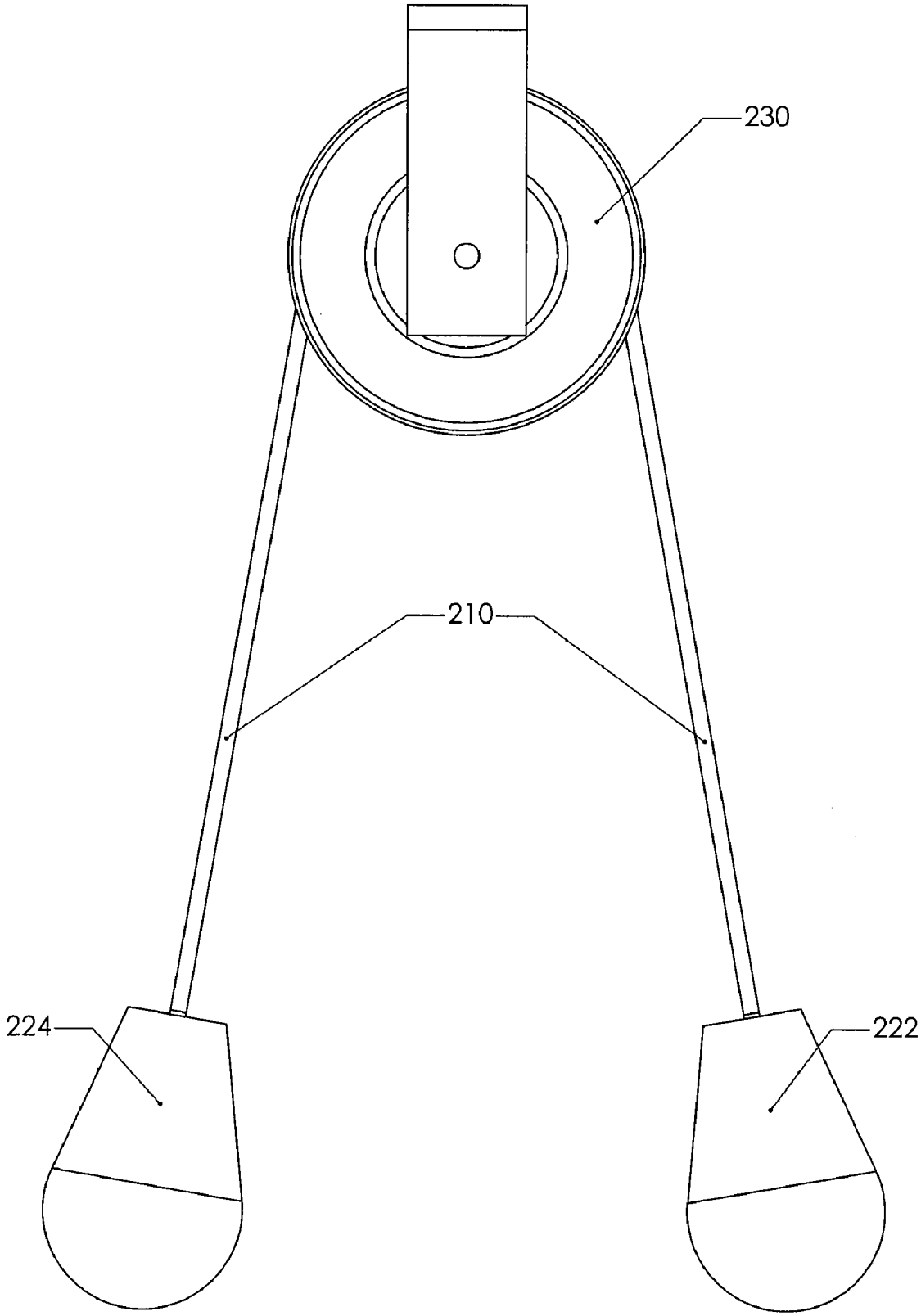
FIG. 4 depicts a first embodiment of the upper body exerciser of the present invention in which the retraction means comprises an elastomeric cord.

Referring to FIG. 4, a first and simplest embodiment of the upper body exerciser 200 of the present invention is depicted. The upper body exerciser 200 generally includes a first and second user member 222/224, a single retraction means 210 and a combining means 230. The user members 222/224 in this embodiment consist of hand-grips, the retraction means 210 includes an elastomeric cord wound around the combining means 230 which includes a fixed pulley. The combining means 230 is coupled to both the retraction means 210 and the first and second user members 222/224, thus providing semi-dependence of the retraction system.

In this first embodiment, when a user pulls one of the user members 222/224 from its retracted position, the cord is energized or stretched to have a stored energy, and the retraction force applied to the other user member by the cord increases. If the user subsequently moves the first and second user members in opposite directions at substantially the same time and rate (e.g., by swinging his or her arms in opposition), it causes the elastomeric cord 210 to cycle back and forth around the pulley 230, but without substantially changing the stored energy in the cord. In this case (i.e., this primary exercise motion of arms moving in opposition), movement or travel of the retraction means 210 is reduced. A user may also simultaneously pull out with both hand-grips 222/224 which increases the tension within the elastomeric cord 210, thereby increasing the retraction force applied to both user members 222/224.

Figure 5B:
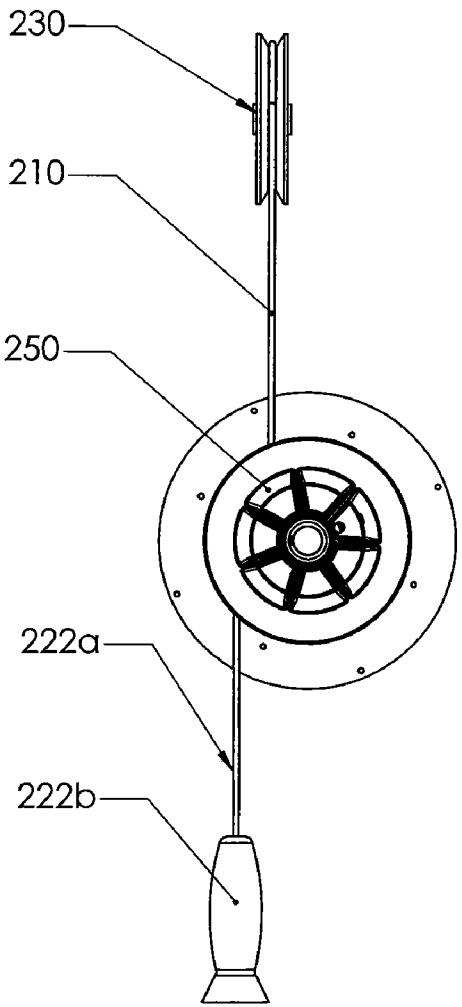
FIGS. 5*a*-*b* depict front and side views of a second embodiment of the upper body exerciser of the present invention representing another version in which the retraction means comprises an elastomeric cord and further consisting of drive and resistance means.
Figure 5A:
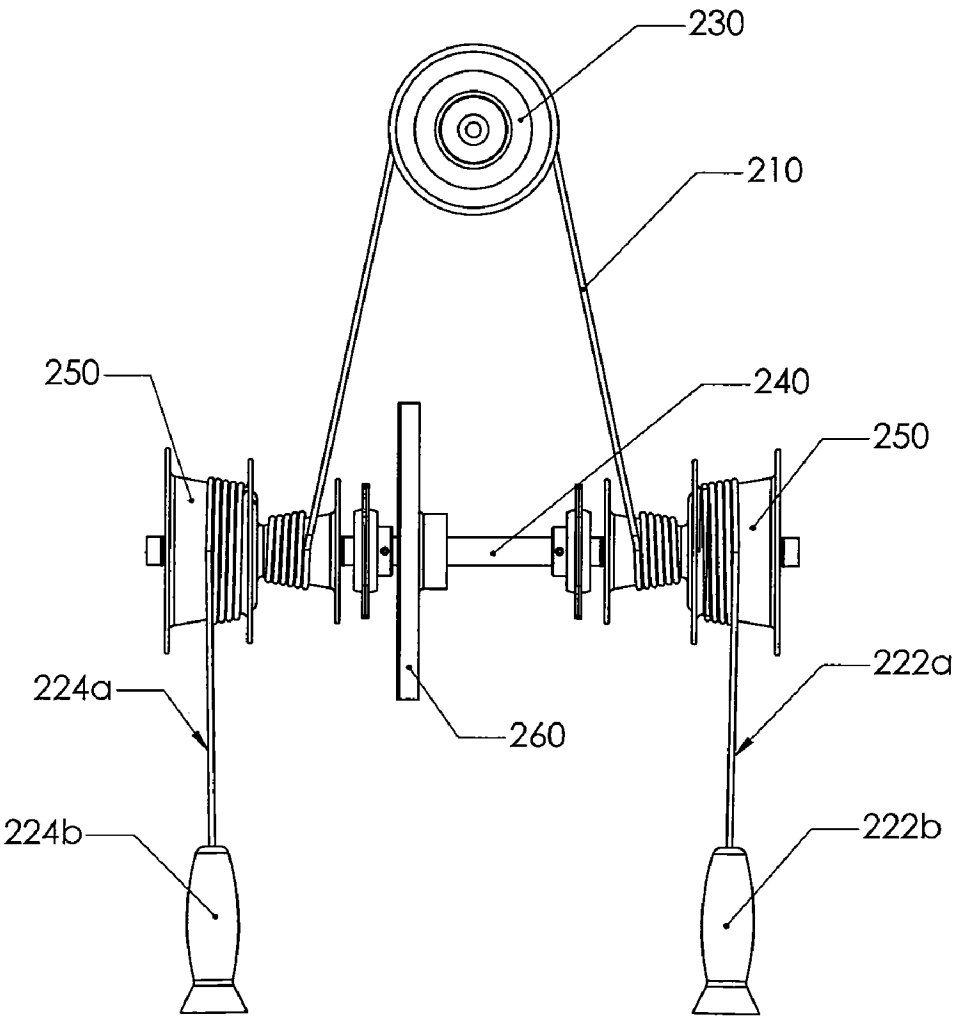
Figure 6A:
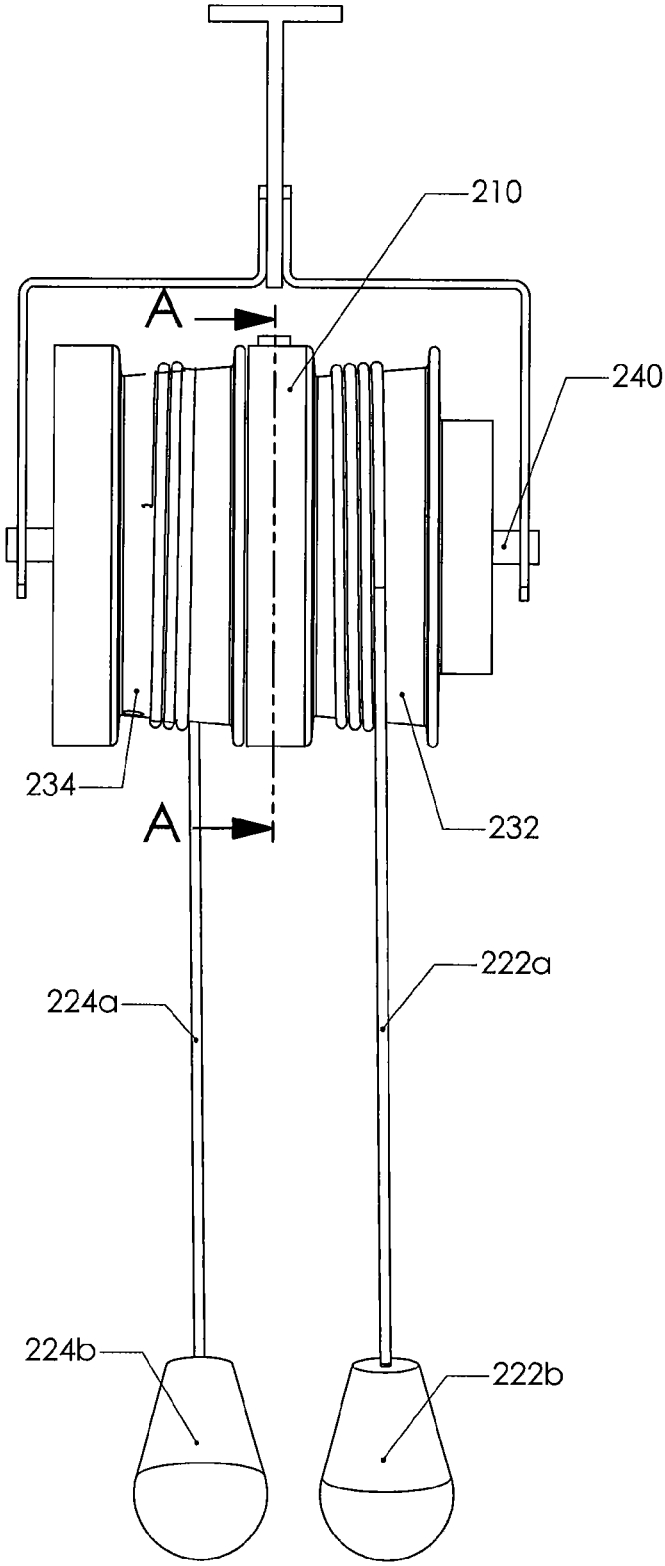
FIGS. 6*a*-6*e* depict various views of a third embodiment of the upper body exerciser of the present invention in which the retraction means comprises a power spring mechanism (e.g., clock spring)
Figure 6B:
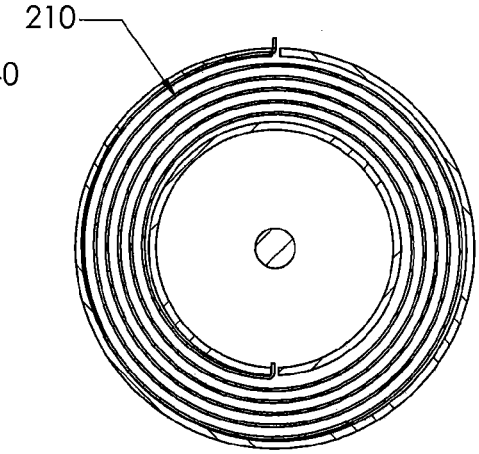
Figure 6C:
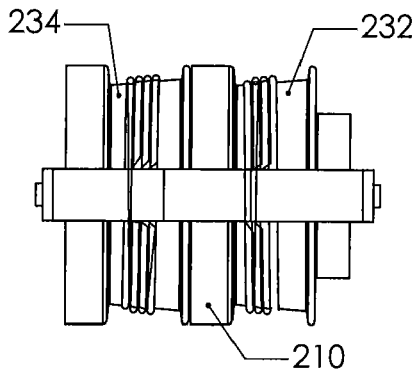
Figure 6D:
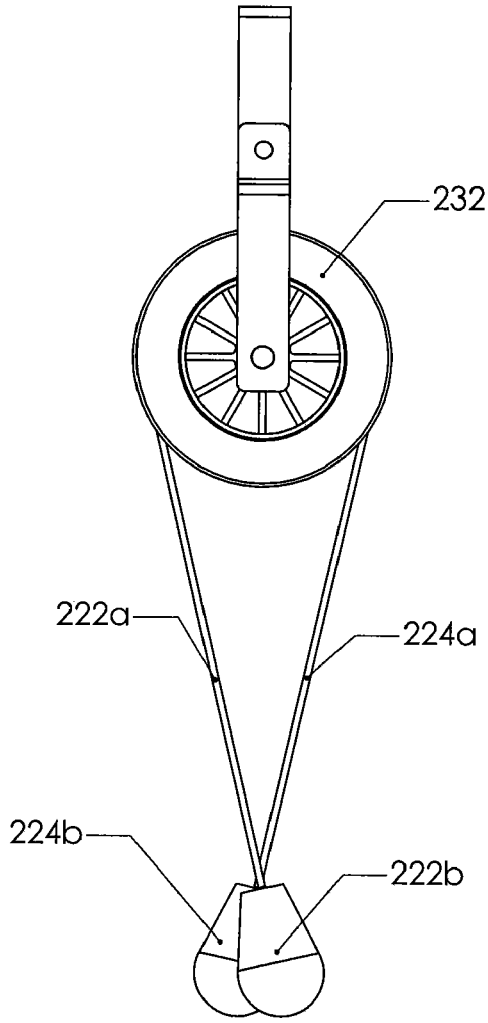
Figure 6E:
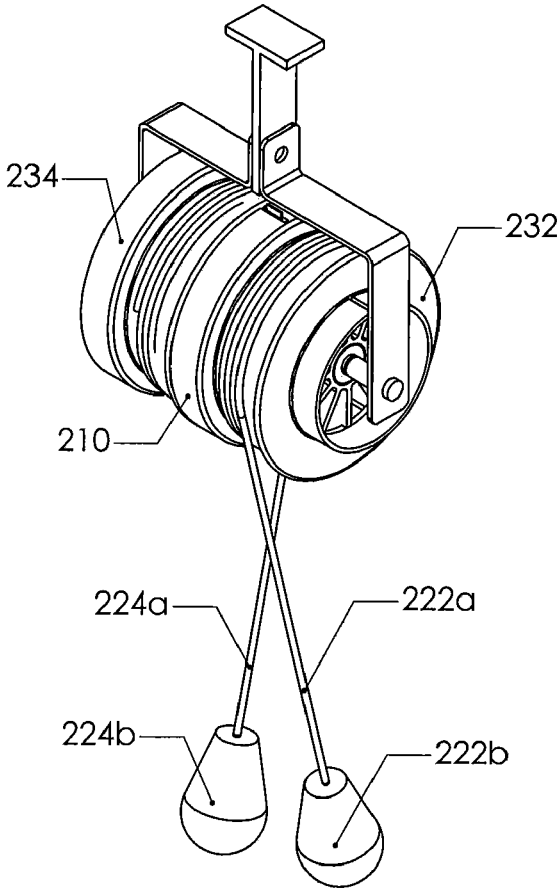

Referring to FIGS. 5*a*-5*b,* a second embodiment of the present invention is depicted. In this embodiment, the upper body exerciser 200 includes first and second user members 222/224, each consisting of a pull cord portion 222*a*/224*a* and a hand-grip portion 222*b*/224*b,* retraction means 210 consisting of an elastomeric cord wound around the combining means 230 which includes a fixed pulley. Unlike the first embodiment, it further includes drive means 250 and resistance means 260 positioned between the user members 222/224 and combining means 230. The combining means 230, like in the simpler version depicted at FIG. 4, remains coupled to both the retraction means 210 and the first and second user members 222/224, thus providing semi-dependence of the retraction system.

In this second embodiment, when a user pulls on the user means 222/224, the drive means 250 (e.g., clutched spools or similar) engages the drive shaft 240, causing it to rotate in one direction. This spins the flywheel and ECB 260, creating additional resistance (adjustable resistance) to the pulling motion. When the user, gripping the hand-grips 222/224, swings his or her arms in opposition, it causes the elastomeric cord 210 to cycle back and forth around the pulley 230. In this case (i.e., the primary exercise motion of arms moving in opposition), movement or travel of the retraction means 210 is reduced. A user may also simultaneously pull out with both hand-grips 222/224 which increases the tension within the elastomeric cord 210, thereby increasing the retraction force applied to both user members 222/224.

Referring to FIGS. 6*a*-6*e,* a third embodiment of the present invention is depicted in which the retraction means 210 includes a torsion spring in the form of a power spring such as a clock spring. The combining means 230 is non-floating and includes a first and a second member 232/234 (i.e., two retraction spools) located to either side of and linked to the clock spring 210 (see in cross-sectional view in FIG. 6*b*). The retraction spools 232/234 and clock spring mechanism 210 are each supported in a fixed position on a support member 240 consisting of a fixed axle, As shown, the retraction spools 232/234 are rotatably mounted on the fixed axle 240, the clock spring 210 is mounted to both of these spools 232/234 and applies a bias to the spools such that, in the absence of all other forces, the two spools counter-rotate relative to one another. Two pull cords 222*a*/224*a* are wound in opposite directions around the retraction spools 232/234, such that the tension in the pull cords 222*a*/224*a* provides a torque to offset the opposing torque of the clock spring 210. In the static condition, the clock spring 210 biases the pull cords to a fully-retracted position.

The first and second user members 222/224 consist of hand-grips 222*b*/224*b* and pull cords 222*a*/224*a*. As mentioned above, the pull cords are wound in opposite directions around the retraction spools 232/234.

In this third embodiment, when one of the user members is moved from its retracted position, the clock spring is energized to have a stored energy, and the retraction force applied to the other user member by the clock spring increases slightly. If the user subsequently moves the first and second user members in opposite directions at substantially the same time and rate (e.g., by swinging his or her arms in opposition), it causes the clock spring to rotate back and forth, but without substantially changing the stored energy in the clock spring. In other words, when a user swings his or her arms in opposition, it causes both the combining means retraction spools 232/234 and the clock spring 210 to rotate together around the fixed axle 240. In this case (i.e., the primary exercise motion of arms moving in opposition), movement or travel of the retraction means 210 is reduced (i.e., the stored energy in the clock spring does not substantially change). When a user pulls both user members 222/224 simultaneously, it causes the two retraction spools 232/234 to counter-rotate, which in turn energizes or increases the tension within the clock spring coils 210.

Figure 7A:
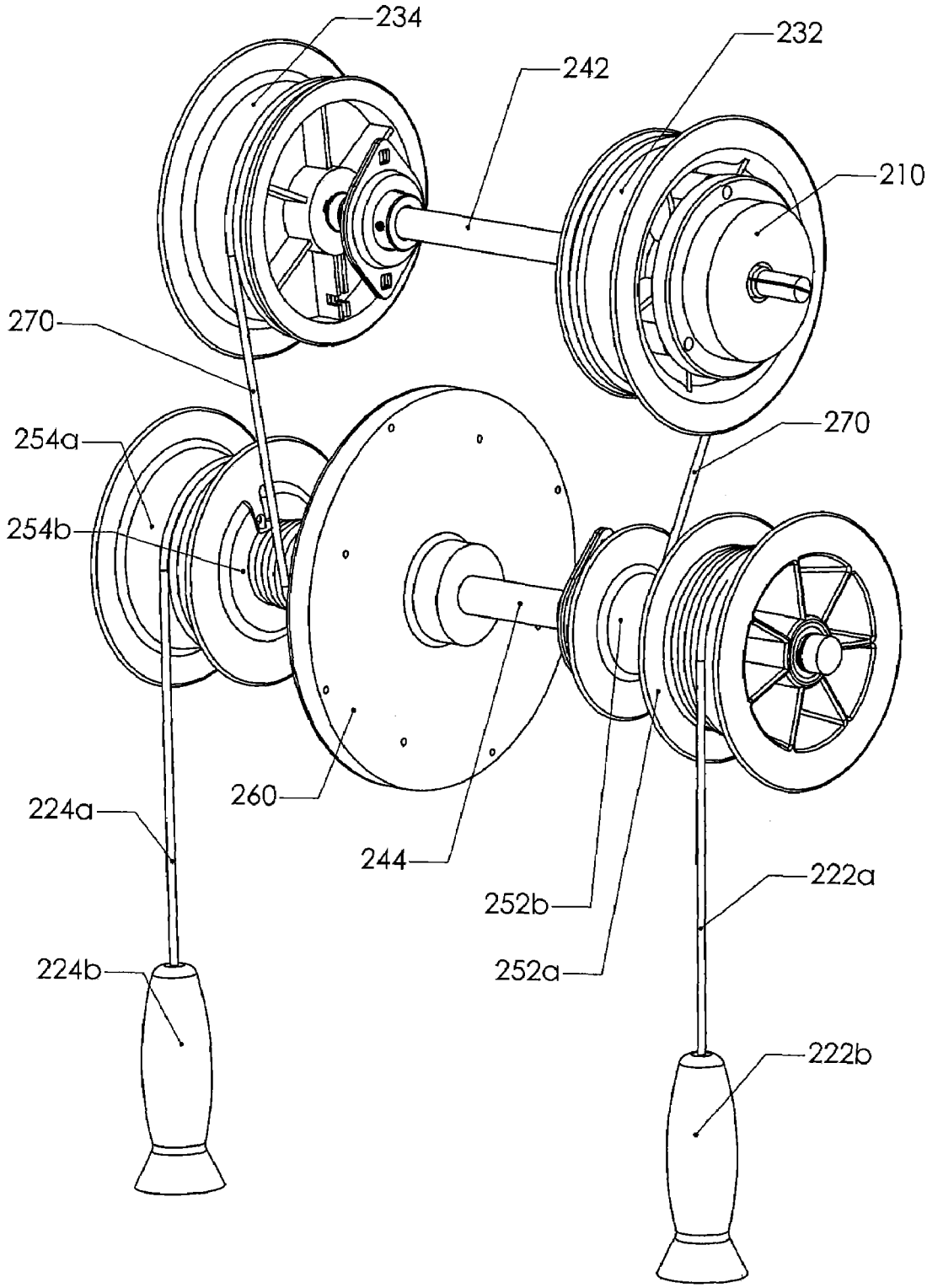
FIGS. 7*a*-7*c* depict views of a fourth embodiment of the upper body exerciser of the present invention in which dual-shafts are employed to support the retraction means (a clock spring), combining means, resistance means and drive mechanism.
Figure 7C:
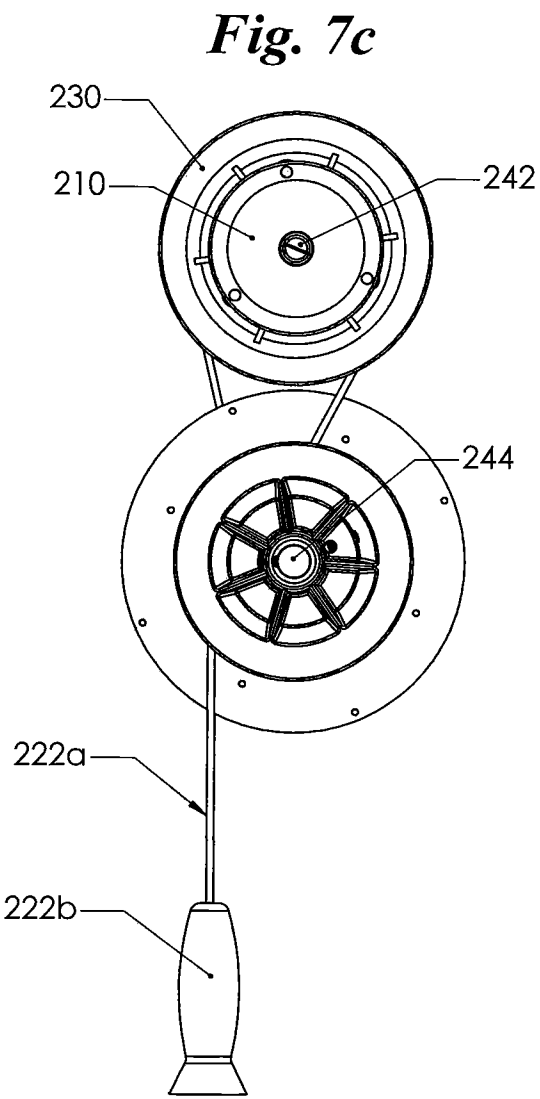
Figure 7B:
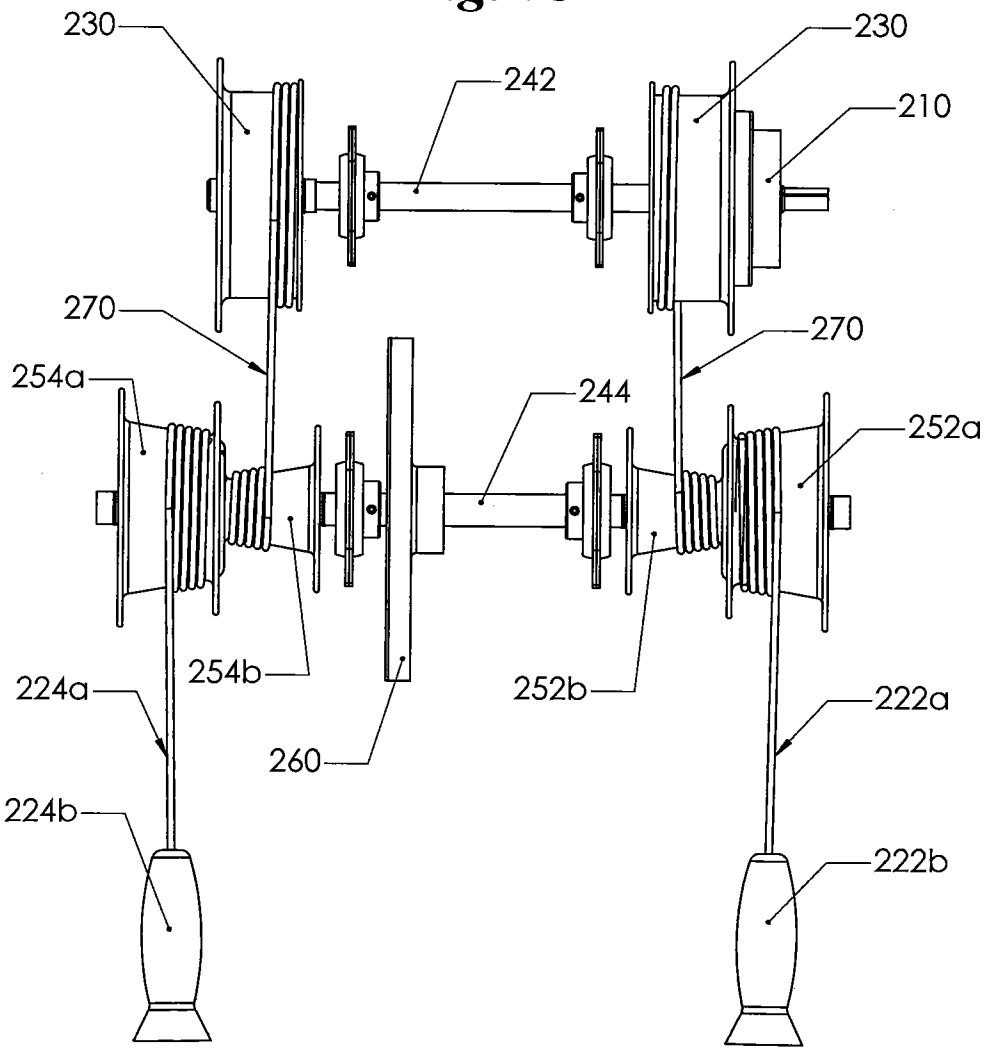

Referring to FIGS. 7*a*-7*c,* a fourth embodiment of the upper body exerciser 200 of the present invention is depicted (top perspective, front and side views, respectively). In this embodiment, the upper body exerciser 200 includes first and second user members 222/224, each consisting of a pull cord portion 222*a*/224*a* and a hand-grip portion 222*b*/224*b,* retraction means 210 consisting of a power spring device such as a clock spring, and non-floating combining means 230 consisting of first and second retraction spools 232/234. It further includes drive means 250 and resistance means 260. Two support members are provided, a first support member 242 and a second support member 244. The drive and resistance means 250, 260 are supported on the second support member 244 and the combining and retraction means 230, 210 are supported on the first support member 242.

The drive means 250 functions to drive the second support member 244 and the resistance means 260. The drive means 250 includes a first and a second clutched spools 252/254, each rotatably mounted on the second support member 244 consisting of a drive shaft. A resistance means 260 is also supported on the second support member 244 (see FIG. 7*a*). The drive means 250 functions to drive the second support member 244 and the resistance means 260.

Each spool of the drive means has a first portion 252*a*/254*a* having a first diameter and a second portion 252*b*/254*b* having a second diameter, the drive means 250 consisting of clutched dual-diameter spools (see FIG. 7*a*). The reader should note that, though the first and second diameters are depicted as different in the figure, they could be the same or, if different, vary as to which portion (i.e., first or second) has the larger or smaller diameter. The first and second user member pull cords 222*a*/224*a* are wound around the first portions 252*a*/254*a* of each spool. Two connecting members 270 are provided consisting of cords (e.g., cords, belts and the like) each having two ends, one end wound around the second portions 252*b*/254*b* of the spools, and the other end wound in opposite directions around the combining means 230. The drive means spools 252/254 are therefore located between the combining means 230 and user members 222/224.

The resistance means 260 provides resistance forces to the first and second user members 222/224 and, as depicted in this embodiment, includes a combination flywheel and ECB. Other types of devices may also suit the purpose of providing resistance forces in this type of embodiment of the upper body exerciser 200.

The combining means 230 includes the first and a second retraction spools 232/234 fixed in position and linked one to the other (i.e., coupled to one another) via the retraction means 210 and shaft 242. The first spool 232 is linked to and rotatably mounted on the oscillating shaft 242. The first spool 232 is connected to the retraction means 210. The second spool 234 is keyed to the first support member 242 consisting of an oscillating shaft. The second spool 234 rotates (or oscillates) with the shaft 242.

The retraction means 210 includes a clock spring device having an interior and exterior portion. The retraction means 210 is coupled to the rotatably mounted spool 232 at its exterior. The retraction means 210 is coupled to the shaft 242 at its interior. The shaft 242 oscillates with the interior portion of the clock spring 210, and the first spool 232 oscillates with the exterior portion of the clock spring 210. All relative motion between the first spool 232 and the shaft 242 is taken up by the clock spring 210, causing it to increase or decrease in tension.

In this fourth embodiment, when the user pulls on the user means 222/224, the drive means 250 (e.g., clutched spools or similar) engages the drive shaft 244, causing it to rotate in one direction. This spins the flywheel and ECB, creating additional resistance (adjustable resistance) to the pulling motion. When the user swings his or her arms in opposition, it causes the retraction spool combining means 232/234, clock spring retraction means 210 and oscillating shaft 242 to rotate together. In this case (i.e., the primary exercise motion of arms moving in opposition), movement or travel of the retraction means 210 (i.e., cycling of the stored energy in the clock spring) is reduced. When the user pulls on both user members 222/224 simultaneously, it causes the two retraction spools 232/234 to counter-rotate, which energizes or increases the tension within the clock spring retraction device 210.

Referring to FIGS. 8*a*-8*d,* a fifth embodiment of the upper body exerciser 200 of the present invention is depicted. The upper body exerciser 200 includes the first and second user members 222/224, drive means 252/254, retractions means 210, combining means 230 and resistance means 260, similarly to the fourth embodiment depicted in FIGS. 7*a-c,* but consisting of only one support member 240.

Figure 8A:
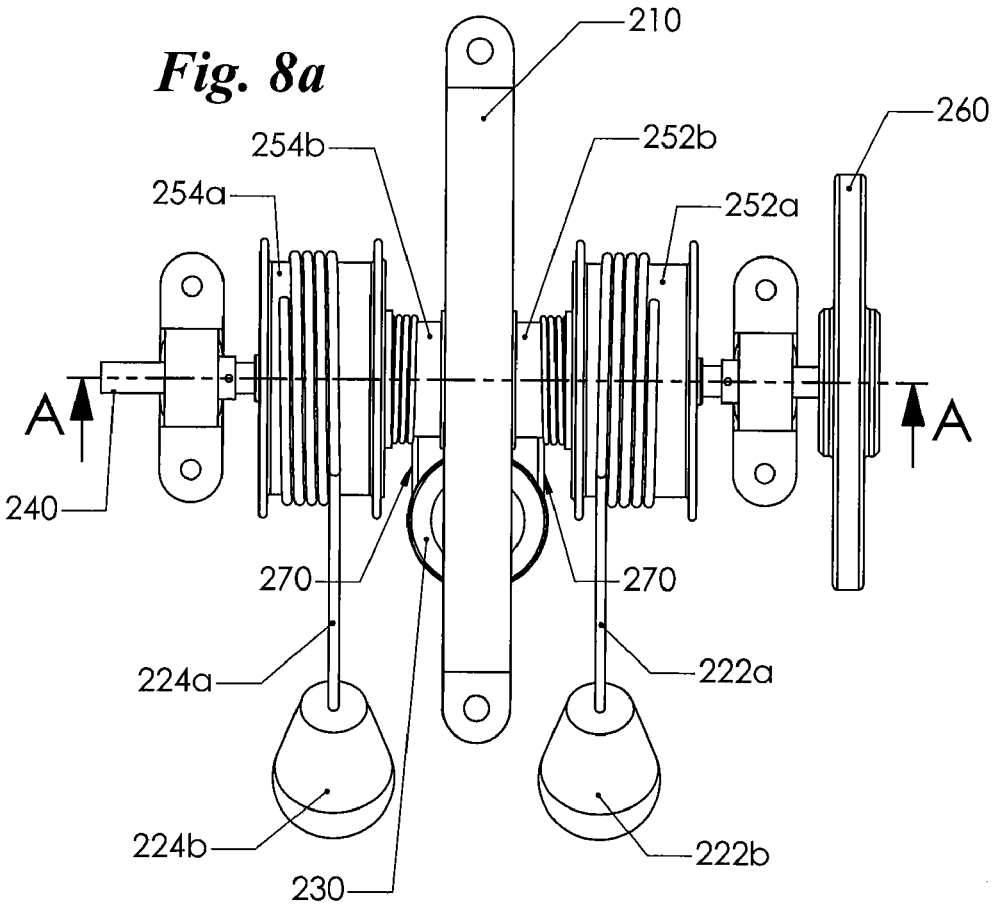
FIGS. 8*a*-8*d* depict various views of a fifth embodiment of the upper body exerciser of the present invention in which the retraction means, combining means, drive means and resistance means are rotatably mounted on a common axle.
Figure 8B:
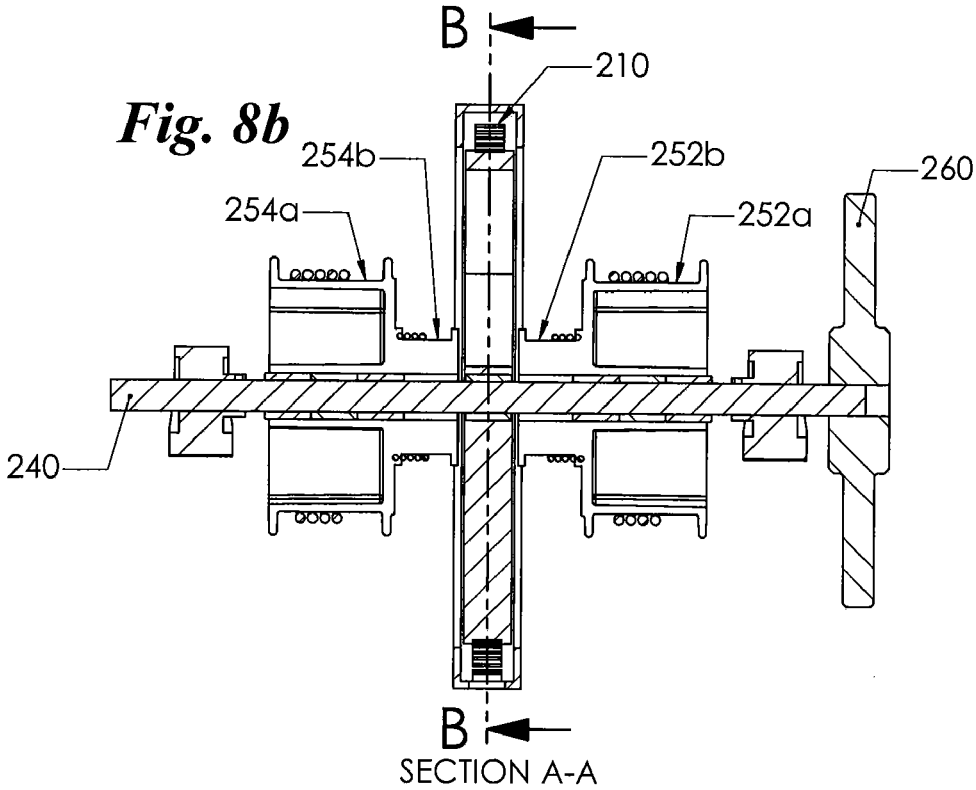
Figure 8C:
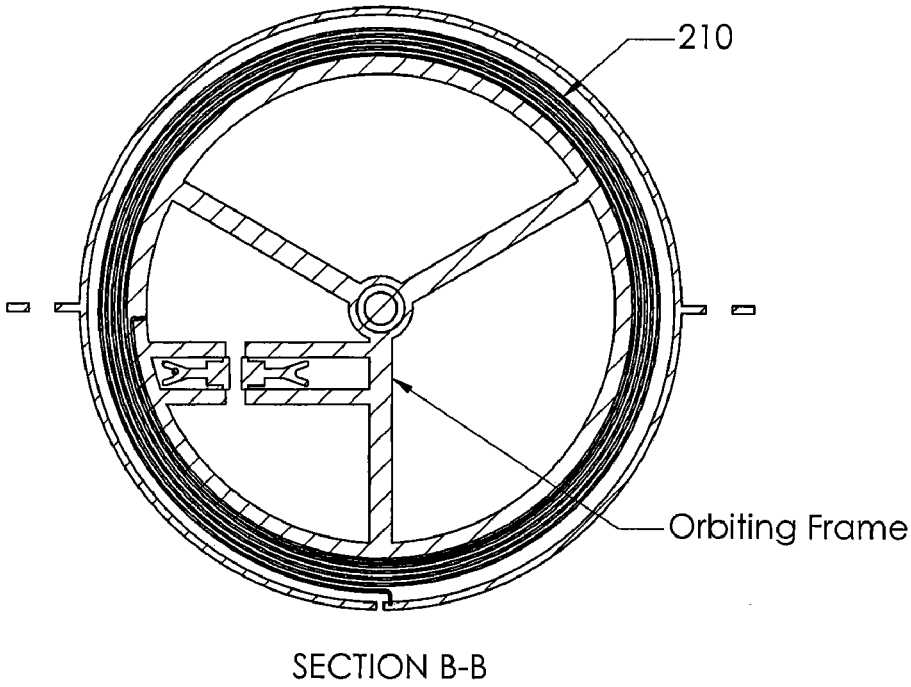
Figure 8D:
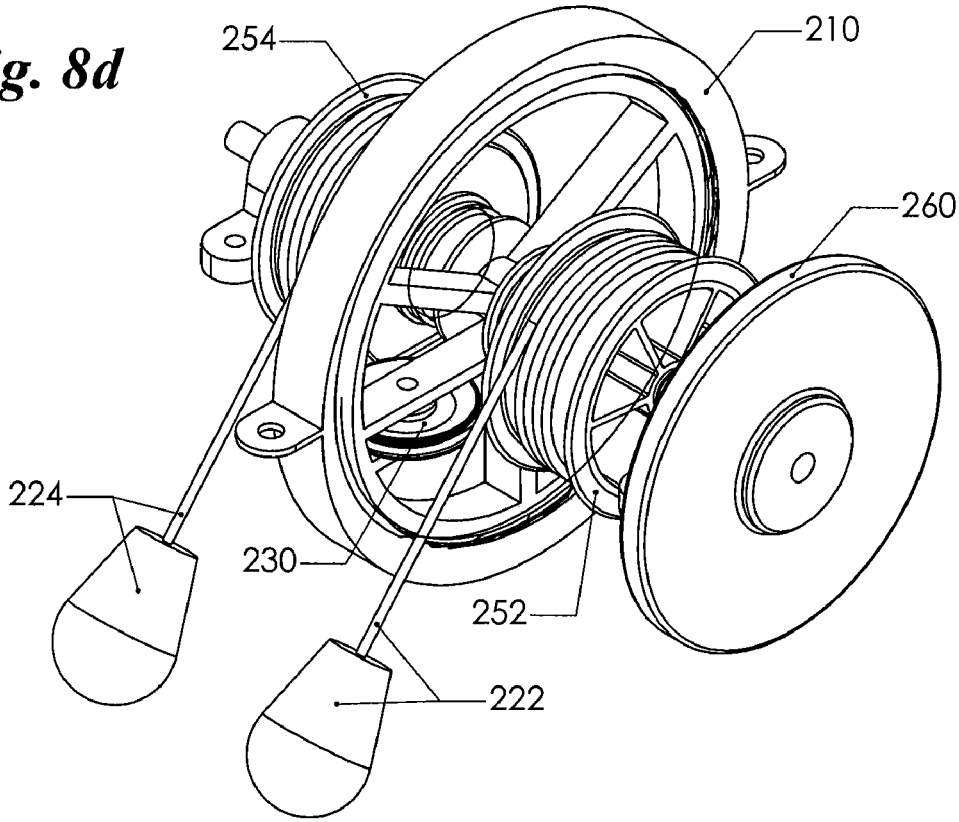

The user members 222/224 each consist of hand-grips 222*b*/224*b* and pull cords 222*a*/224*a.* The retraction means 210 includes a power spring device such as a clock spring (see cross sectional views in FIGS. 8*b* and 8*c*). The resistance means 260 includes a combination flywheel and ECB.

The drive means 250 functions to drive a support member 240 and the resistance means 260. The drive means 250 includes a first and a second clutched spools 252/254, each rotatably mounted on the support member 240 consisting of a drive shaft. Each spool of the drive means has a first portion 252*a*/254*a* having a first diameter and a second portion 252*b*/254*b* having a second diameter, the drive means 250 therefore consisting of clutched dual-diameter spools 252/254. The reader should note that, though the first and second diameters are depicted as different in the figure, they could be the same or, if different, vary as to which portion (i.e., first or second) has the larger or smaller diameter. The pull cords 222*a*/224*a* of the user members are wound around the first portions 252*a*/254*a* of the drive means. The drive means spools 252/254 are therefore located between the combining means 230 and user members 222/224. A resistance means 260 is also mounted on the support member 240 (see FIG. 8*a*).

The combining means 230 includes a pulley that is attached to a rotatable frame that can rotate around the support member 240 (i.e., drive shaft). The pulley is offset from the frames center of rotation, so that when the frame rotates about the support member 240, this causes the pulley to orbit about the support member 240. Two connecting members 270 are provided, consisting of cords each having two ends. The connecting members 270 are wound around the second portions 252*b*/254*b* of the spools at one end, and around the combining means orbiting pulley 230 at the other end.

In this fifth embodiment, when a user swings out his or her arms in opposition, it causes the drive members 252/254 to spin in opposition, and connecting members 270 (retraction cords) to cycle over combining means pulley 230 back and forth between drive members 252/254. In this case, the combining pulley 230 remains stationary in space (only rotating in place), and the retraction means clock spring 210 is not cycled (i.e., does not move or travel at all). In this case (i.e., the primary exercise motion of arms moving in opposition), movement or travel of the retraction means 210 is reduced. By contrast, when user pulls out on both user members 222/224 simultaneously, the combining pulley 230 is required to orbit around the first support member 242 (drive shaft), causing the retraction means clock spring 210 to rotate, increasing tension within the clock spring.

Referring to FIGS. 9*a*-9*d,* a sixth embodiment of the upper body exerciser 200 of the present invention is depicted showing a differential gear mechanism. The upper body exerciser 200 includes the first and second user members 222/224, drive means 252/254, connecting members 270, retraction means 210, combining means 230 and resistance means 260.

Figure 9A:
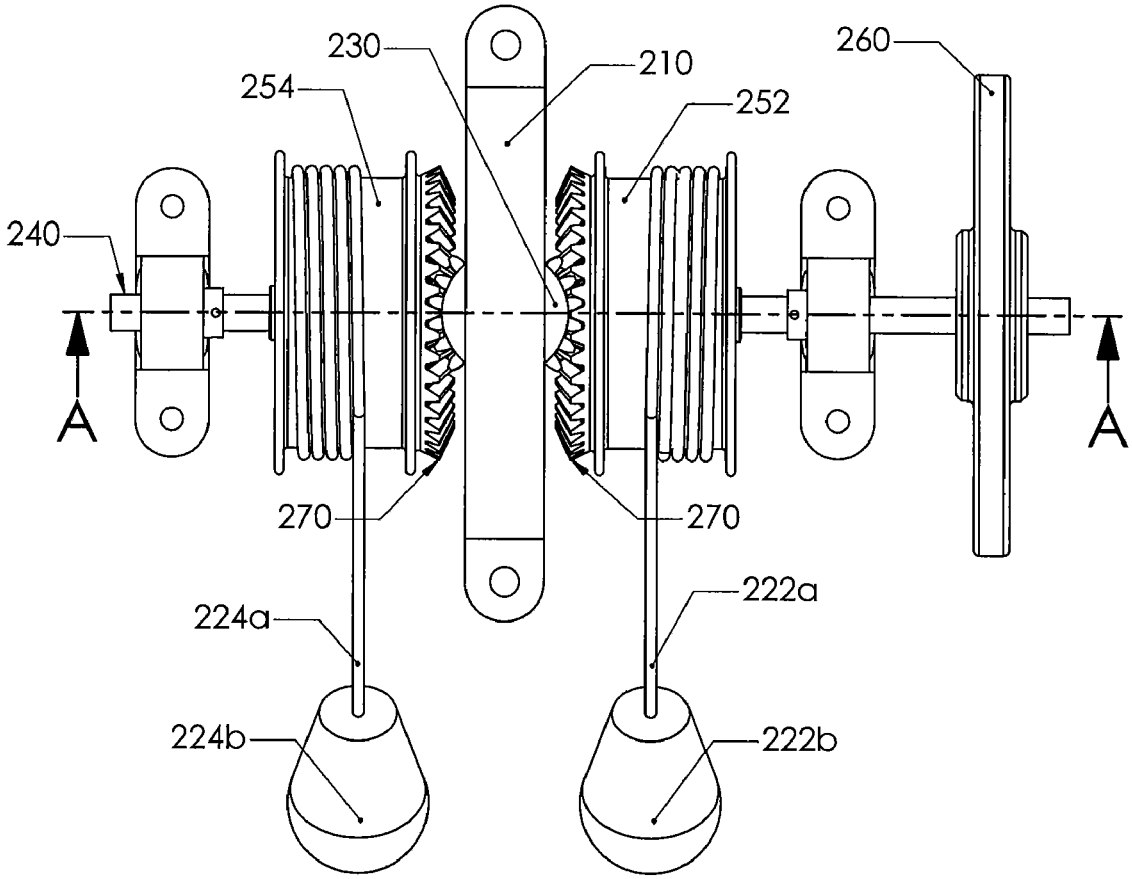
FIG. 9*a* depicts a top view.
Figure 9B:
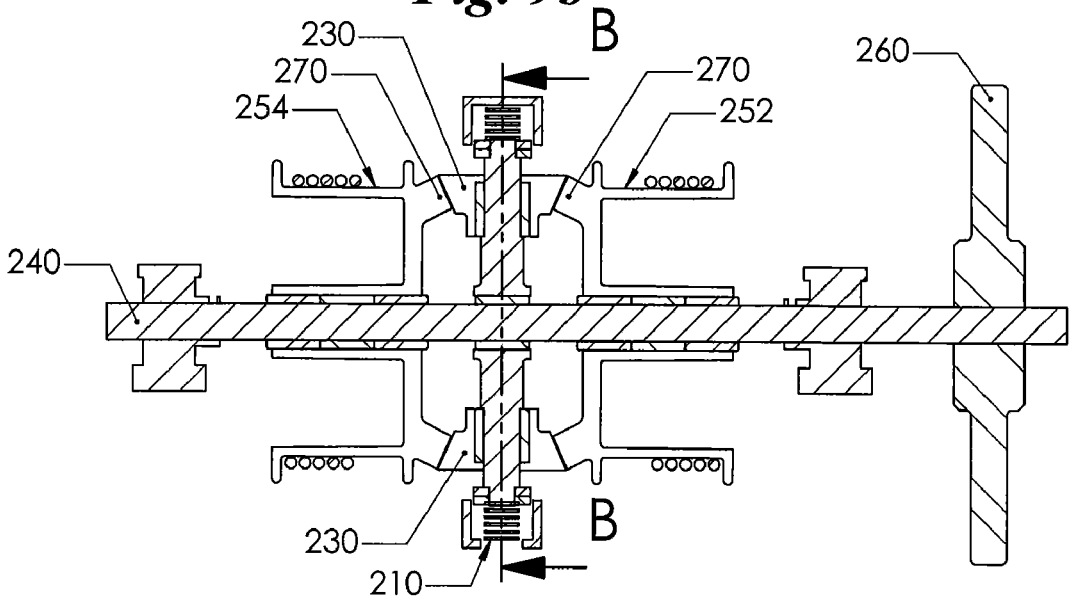
Figure 9C:
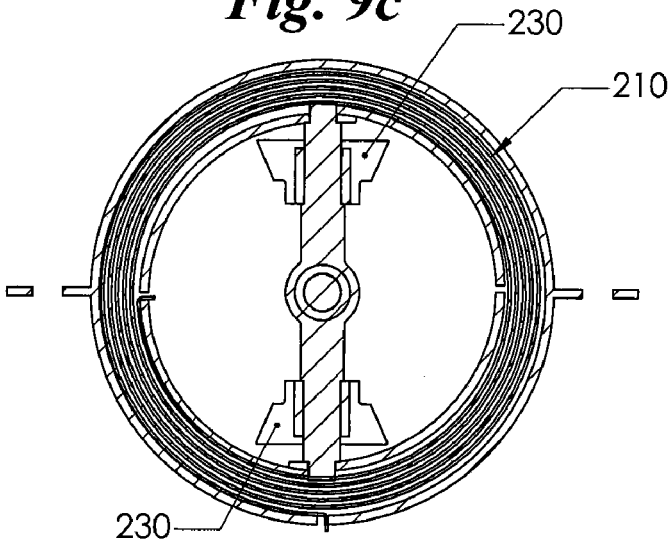
* FIG. 9*c* depicts a cross-sectional view through section B-B as shown in FIG. 9*b;* and, FIG. 9*d* depicts a top perspective view of this version.

The user members 222/224 each consist of hand-grips 222*b*/224*b* and pull cords 222*a*/224*a.* The retraction means 210 includes a clock spring device (see cross sectional views in FIGS. 9*b* and 9*c*). The resistance means 260 includes a combination flywheel and ECB.

The drive means 250 functions to drive a support member 240 and the resistance means 260. The drive means 250 includes a first and a second clutched spool 252/254, each rotatably mounted on the support member 240 consisting of a drive shaft. The resistance means 260 is also mounted on the support member 240 (see FIGS. 9*a,b*).

Figure 9D:
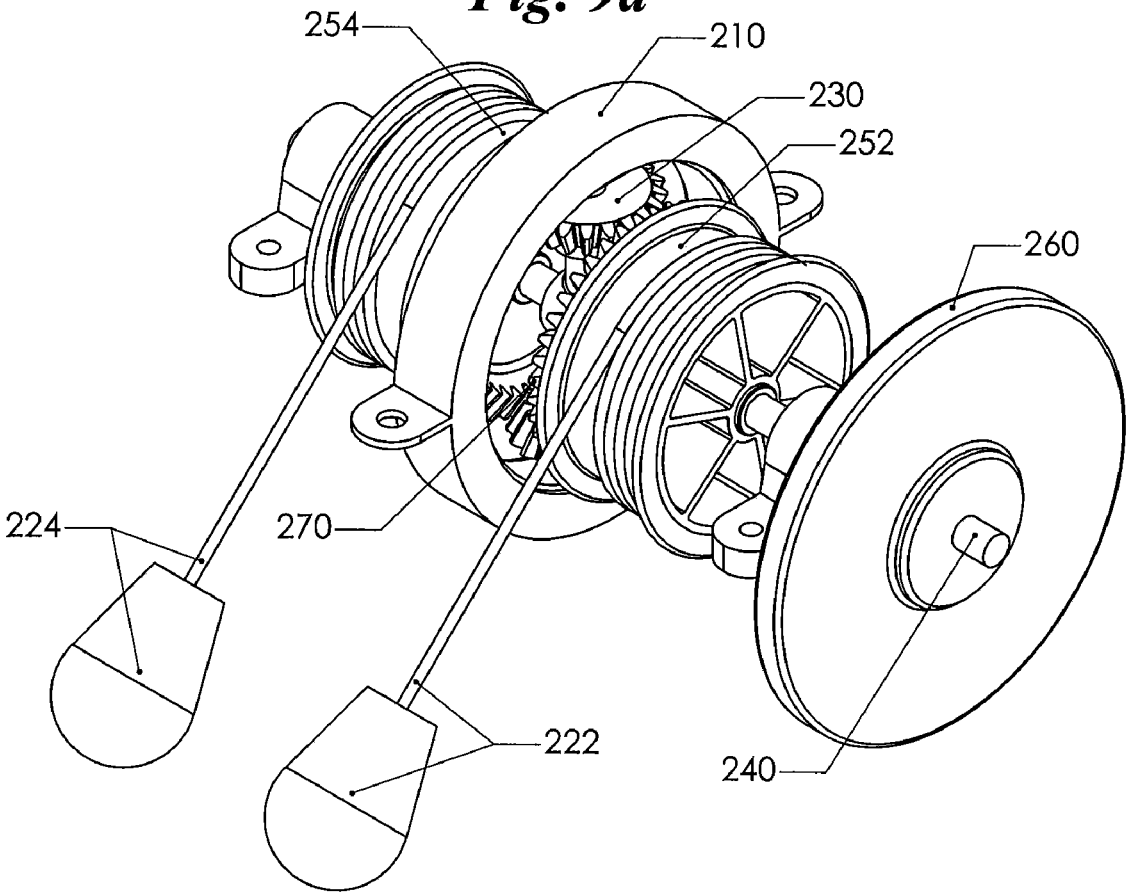

The combining means 230 includes a pinion gear that that is attached to a rotatable frame that can rotate around the support member 240 (i.e., drive shaft; see FIGS. 9*c*-9*d*). The pinion gear is offset from the frames center of rotation, so that when the frame rotates about the support member 240, this causes the pinion gear to orbit about the support member 240. Two connecting members 270 are provided, consisting of side gears attached to each of the drive spools 252/254, each having gear teeth meshed with the gear teeth of the combining means pinion gear 230 to form a differential gear mechanism.

In this sixth embodiment, when a user swings out his or her arms in opposition, it causes the drive members 252/254 to spin in opposition, which also causes connecting members 270 (i.e., side gear teeth on drive spools 252/254) to spin in opposition. This causes combining means pinion gear 230 to spin in place between drive members 252/254. In this case, the combining pinion gear 230 remains stationary in space (only rotating in place), and the retraction means clock spring 210 is not cycled (i.e., does not move or travel at all). In this case (i.e., during primary exercise motion of arms moving in opposition), movement or travel of the retraction means 210 is reduced. By contrast, when user pulls out on both user members 222/224 simultaneously, the combining means pinion gear 230 is driven by the gear teeth of the connecting members 270 (i.e., side gears), forcing the pinion gear to orbit around the first support member 242 (i.e., drive shaft). This causes the retraction means clock spring 210 to rotate, increasing tension within the clock spring.

The previously described versions of the present invention have many advantages, including: (a) providing a dual-function exercise machine with an integrated durable and long-wearing upper body exerciser employing a semi-dependent retraction system so as to provide the smooth feel of an independent retraction system, but without the variation in load force with extension of pull cords and disadvantage of short cycle life of its retraction means; (b) providing the functionality of an upper body exerciser as recited at (a) in a standalone version that can be used with existing lower body exercisers; and, (c) providing the functionality of an upper body exerciser as recited at (a) in a self-contained version that can be attached to an existing lower body exerciser as an add-on feature.

The present invention does not require that all the advantageous features and all the advantages need to be incorporated into every embodiment thereof.

Although the present invention has been described in considerable detail with reference to certain preferred versions thereof, other versions are possible. Therefore, the spirit and scope of the appended claims should not be limited to the description of the preferred versions contained herein.

What is claimed is

1. A treading exerciser assembly comprising:

a) a treadmill including a movable surface;

b) an upper body exerciser coupled to the treadmill and adapted to be utilized by a user on the treadmill, the upper body exerciser comprising:

i) a torsion spring having a first end and a second end;

ii) a first user member adapted to be engaged by a user's hand and movable from a first start position to a first extended position, the first user member being coupled to the first end of the torsion spring and being biased toward the first start position by the torsion spring; and iii) a second user member adapted to be engaged by a user's hand and movable from a second start position to a second extended position, the second user member being coupled to the second end of the torsion spring and being biased toward the second start position by the torsion spring, the retractor simultaneously biasing the first user member and the second user member toward the first start position and the second start position, respectively, wherein the torsion spring provides a first retraction force to the first user member, and wherein the torsion spring is coupled between the first user member and the second user member such that movement of the second user member from the second start position to the second extended position causes the first retraction force applied by the torsion spring to the first user member to increase.

2. The treading exerciser of claim 1, wherein the torsion spring is mounted for rotation.

3. A method of operating a treading exerciser assembly having a treadmill including a movable surface, and further having an upper body exerciser coupled to the treadmill, the upper body exerciser including a first user member adapted to be engaged by a user's hand and movable from a first retracted position toward a first extended position, and a second user member adapted to be engaged by a user's other hand and movable from a second retracted position toward a second extended position, the method comprising:

providing a torsion spring coupled between the first user member and the second user member, the torsion spring having a first end coupled to the first user member and a second end coupled to the second user member;

moving the movable surface;

with the torsion spring, simultaneously applying a first retraction force to the first user member and a second retraction force to the second user member;

moving the second user member from the second retracted position toward the second extended position while maintaining the first user member in the first retracted position; and increasing the first retraction force applied by the torsion spring to the first user member as a result of moving the second user member while maintaining the first user member in the first retracted position.

4. The method of claim 3 further comprising:

moving the first user member from the first retracted position toward the first extended position while maintaining the second user member in the second retracted position; and increasing the second retraction force applied by the torsion spring to the second user member as a result of moving the first user member while maintaining the second user member in the second retracted position.

5. The method of claim 3, wherein the torsion spring includes an intermediate spring portion connected between the first end and the second end, and wherein increasing the first retraction force includes energizing the intermediate spring portion of the torsion spring to have a stored energy.

6. The method of claim 5, further comprising:

moving the first user member and the second user member in substantially opposing directions at substantially the same time and rate; and maintaining the stored energy in the intermediate spring portion of the torsion spring substantially constant while the first and second user members are being moved in substantially opposing directions at substantially the same time and rate.

7. The method of claim 3, wherein the torsion spring is mounted for rotation, and wherein moving the first and second user members in substantially opposing directions at substantially the same time and rate includes rotating the torsion spring.

8. The method of claim 3 wherein moving the movable surface includes activating the treadmill.

9. The method of claim 3 wherein moving the second user member comprises engaging a user's hand with the second user member.

10. A method of operating a treading exerciser assembly having a treadmill including a movable surface, and further having an upper body exerciser coupled to the treadmill, the upper body exerciser including a torsion spring having a first end, a second end, and an intermediate spring portion connected between the first end and the second end, a first user member adapted to be engaged by a user's hand and movable from a first retracted position toward a first extended position, a second user member adapted to be engaged by a user's other hand and movable from a second retracted position toward a second extended position, and a connecting assembly including a shaft supported for pivoting movement and coupled to the first end of the torsion spring, a first pulley supported for pivoting movement with the shaft, the first user member being coupled to the first pulley, and a second pulley supported for pivoting movement relative to the shaft and coupled to the second end of the torsion spring the second user member being coupled to the second pulley, the method comprising:

moving the movable surface;

energizing the intermediate spring portion of the torsion spring to create stored energy in the intermediate spring portion of the torsion spring by moving the first user member toward the first extended position, movement of the first user member toward the first extended position causing pivoting movement of the first pulley and the shaft to thereby energize the intermediate spring portion of the torsion spring;

moving the first user member and the second user member in substantially opposing directions at substantially the same time and rate, movement of the first user member causing pivoting movement of the first pulley and the shaft and movement of the second user member causing pivoting movement of the second pulley relative to the shaft; and maintaining the stored energy in the intermediate spring portion of the torsion spring substantially constant while the first user member and the second user member are being moved in substantially opposing directions at substantially the same time and rate.

11. The method of claim 10, wherein the torsion spring is mounted for rotation, and wherein moving the first and second user members in substantially opposing directions at substantially the same time and rate includes rotating the torsion spring.

12. The method of claim 10 wherein moving the movable surface includes activating the treadmill.

13. The method of claim 10 wherein moving the first user member and second user member comprises engaging one of a user's hand with the first user member and the other of a user's hand with the second user member.

14. The treading exerciser of claim 1, wherein the upper body exerciser further comprises a connecting assembly including a shaft supported for pivoting movement and coupled to the first end of the retractor, a first pulley supported for pivoting movement with the shaft, a first cord coupling the first user member to the first pulley, a second pulley supported for pivoting movement relative to the shaft and coupled to the second end of the retractor, and a second cord coupling the second user member to the second pulley, wherein movement of the first user member from the first retracted position toward the first extended position causes movement of the first cord thereby causing pivoting movement of the first pulley in a first direction relative to an axis of the shaft, and wherein movement of the second user member from the second retracted position toward the second extended position causes movement of the second cord thereby causing pivoting movement of the second pulley in an opposite second direction relative to the axis of the shaft.

15. The treading exerciser of claim 1, wherein the upper body exerciser further includes a connecting assembly including a shaft supported for pivoting movement and coupled to the first end of the torsion spring, a first pivoting member supported for pivoting movement with the shaft, a first cord coupling the first user member to the first pivoting member, a second pivoting member supported for pivoting movement relative to the shaft and coupled to the second end of the torsion spring and a second cord coupling the second user member to the second pivoting member.

16. A treading exerciser assembly comprising:

a) a treadmill including a movable surface; and b) an upper body exerciser coupled to the treadmill and adapted to be utilized by a user on the treadmill, the upper body exerciser comprising:

i) a first user member adapted to be engaged by a user's hand and movable from a first start position to a first extended position;

ii) a second user member adapted to be engaged by a user's hand and movable from a second start position to a second extended position, iii) a connector assembly including (1) a pivotable shaft, (2) a first pulley supported for pivoting movement with the shaft, a first cord coupling the first user member to the first pulley, movement of the first user member causing movement of the first cord and thereby causing pivoting movement of the first pulley, and (3) a second pulley supported for pivoting movement relative to the shaft, a second cord coupling the second user member to the second pulley, movement of the second user member causing movement of the second cord and thereby causing pivoting movement of the second pulley, and iv) a torsion spring having a first end coupled to the shaft for pivoting movement with the shaft and a second end coupled to the second pulley for pivoting movement with the second pulley, the torsion spring biasing the first user member toward the first start position, the torsion spring simultaneously biasing the second user member toward the second start position, the torsion spring providing a first retraction force to the first user member, the torsion spring being coupled by the connecting assembly between the first user member and the second user member such that movement of the second user member from the second start position to the second extended position causes the first retraction force applied by the torsion spring to the first user member to increase.

17. A method of operating a treading exerciser assembly having a treadmill including a movable surface, and further having an upper body exerciser coupled to the treadmill, the upper body exerciser including a first user member adapted to be engaged by a user's hand and movable from a first retracted position toward a first extended position, a second user member adapted to be engaged by a user's other hand and movable from a second retracted position toward a second extended position, a connecting assembly including a shaft supported for pivoting movement, a first pulley supported for pivoting movement with the shaft, a first cord coupling the first user member to the first pulley, a second pulley supported for pivoting movement relative to the shaft, and a second cord coupling the second user member to the second pulley, and a torsion spring coupled between the first user member and the second user member, the torsion spring having a first end coupled to the shaft and a second end coupled to the second pulley, the method comprising:

moving the movable surface;

applying a first retraction force with the torsion spring to the first user member;

moving the second user member from the second retracted position toward the second extended position while maintaining the first user member in the first retracted position, movement of the second user member causing movement of the second cord and thereby causing pivoting movement of the second pulley; and increasing the first retraction force applied by the torsion spring to the first user member as a result of moving the second user member while maintaining the first user member in the first retracted position.

18. A method of operating a treading exerciser assembly having a treadmill including a movable surface, and further having an upper body exerciser coupled to the treadmill, the upper body exerciser including a first user member adapted to be engaged by a user's hand and movable from a first retracted position toward a first extended position, a second user member adapted to be engaged by a user's other hand and movable from a second retracted position toward a second extended position, a connecting assembly including a shaft supported for pivoting movement, a first pulley supported for pivoting movement with the shaft, a first cord coupling the first user member to the first pulley, a second pulley supported for pivoting movement relative to the shaft, and a second cord coupling the second user member to the second pulley, and a torsion spring coupled between the first user member and the second user member, the torsion spring having a first end coupled to the shaft, a second end coupled to the second pulley, and an intermediate spring portion connected between the first end and the second end, the method comprising:

moving the movable surface;

energizing the intermediate spring portion of the torsion spring to create stored energy in the intermediate spring portion of the torsion spring by moving the first user member toward the first extended position, movement of the first user member toward the first extended position causing movement of the first cord and thereby causing pivoting movement of the first pulley and the shaft to thereby energize the intermediate spring portion of the torsion spring;

moving the first user member and the second user member in substantially opposing directions at substantially the same time and rate, movement of the first user member causing movement of the first cord and thereby causing pivoting movement of the first pulley and the shaft, movement of the second user member causing movement of the second cord and thereby causing pivoting movement of the second pulley relative to the shaft; and maintaining the stored energy in the intermediate spring portion of the torsion spring substantially constant while the first and second user members are being moved in substantially opposing directions at substantially the same time and rate.

* * * * *

UNITED STATES PATENT AND TRADEMARK OFFICE

CERTIFICATE OF CORRECTION

PATENT NO. : 7,524,272 B2
APPLICATION NO. : 11/423537
DATED : April 28, 2009
INVENTOR(S) : Robert C. Burck et al.

It is certified that error appears in the above-identified patent and that said Letters Patent is hereby corrected as shown below:

On the title page, item (75):

change “Robert C. Bruck” to --Robert C. Burck--

Col. 13, Claim 1, line 24:

change “by the torsion spring, the retractor simultaneously” to --by the torsion spring, the torsion spring simultaneously--

Col. 15, Claim 14, line 15:

change “coupled to the first end of the retractor” to --coupled to the first end of the torsion spring--

Col. 15, Claim 14, line 19:

change “second end of the retractor” to --second end of the torsion spring--

Signed and Sealed this

Twenty-third Day of June, 2009

JOHN DOLL
*Acting Director of the United States Patent and Trademark Office*